US005322832A

United States Patent [19]

Takeyama et al.

[11] Patent Number: 5,322,832

[45] Date of Patent: Jun. 21, 1994

[54] IMAGE-RECEIVING SHEET FOR THERMAL-TRANSFER RECORDING MEDIUM

[75] Inventors: Toshihisa Takeyama; Naoyo Suzuki; Shigehiro Kitamura, all of Hino, Japan

[73] Assignee: Konica Corporation, Tokyo, Japan

[21] Appl. No.: 932,788

[22] Filed: Aug. 20, 1992

[30] Foreign Application Priority Data

Oct. 3, 1991 [JP] Japan ..... 3-256686

[51] Int. Cl.[5] ..... B41M 5/035; B41M 5/38

[52] U.S. Cl. ..... 503/227; 428/195; 428/207; 428/913; 428/914

[58] Field of Search ..... 8/471; 428/195, 207, 428/323, 913, 914; 503/227

[56] References Cited

U.S. PATENT DOCUMENTS

| | | | |
|---|---|---|---|
| 4,058,401 | 11/1977 | Crivello | 96/115 R |
| 4,069,055 | 1/1978 | Crivello | 96/115 R |
| 4,101,513 | 7/1978 | Fox et al. | 526/193 |
| 4,161,478 | 7/1979 | Crivello | 260/327 B |
| 4,987,049 | 1/1991 | Komamura et al. | 430/203 |

*Primary Examiner*—B. Hamilton Hess

*Attorney, Agent, or Firm*—Frishauf, Holtz, Goodman & Woodward

[57] ABSTRACT

Disclosed is an image receiving sheet for thermal-transfer recording medium, which comprises a support and provided thereon, an image-receiving layer containing a resin having a dyeability to a thermal diffusible dye, wherein said image-receiving layer contains an inorganic oxide capable of absorbing UV-rays.

An image receiving sheet for thermal-transfer recording medium is improved in an image preservabilities, a light-fastness and a dye-bleeding resistance.

14 Claims, 3 Drawing Sheets

IMAGE-RECEIVING SHEET FOR THERMAL-TRANSFER RECORDING MEDIUM

FIELD OF THE INVENTION

This invention relates to an image-receiving sheet for thermal-transfer recording use and an image-protective material and, particularly, to an image-receiving sheet for thermal-transfer recording use, an image-protective material, an image-protecting method and an image-recording material each excellent in image preservabilities including, particularly, light-fastness and dye-bleeding resistance.

BACKGROUND OF THE INVENTION

As for the techniques for obtaining color hard-copies, the color-recording techniques applied with an ink-jet system, an electrophotographic system or a thermal-transfer system have been studied so far. Among these systems, the thermal-transfer system has the following advantages that the operation or maintenance can readily be performed, that the apparatus can be miniaturized, that the cost can be saved and that the running cost can also be made inexpensive.

The thermal-transfer systems may be classified into the following two: namely, a system in which a transfer-sheet comprising a support bearing a thermally fusible ink-layer thereon (hereinafter referred sometimes to as a thermal-transfer recording material) is heated by a thermal-head so that the ink may be so fused as to be transferred from the thermally fusible ink-layer onto an image-receiving sheet for thermal-transfer recording use; and the other system (which may be so-called a thermal diffusion-transfer system or a sublimation-transfer system) in which a transfer-sheet comprising a support bearing an ink layer containing a thermally diffusible dye (or, a sublimatable dye) thereon is heated by a thermal-head so that the thermally diffusible dye may be transferred from the ink-layer onto the image-receiving sheet for thermal-transfer recording use. The latter system is more advantageous for full-color recording, because image gradation can be controlled by changing the dye-transfer amount so as to meet the thermal-energy variations of a thermal-head.

When a thermal-transfer recording operation is carried out in the thermal diffusion-transfer system, the dyes applicable to a thermal-transfer recording material play an important role. However, none of the conventional dyes have been satisfactory to improve the stabilities of the resulting image including, for example, the heat resistance, light fastness, fixing property and image-bleeding resistance thereof.

For improving the above-mentioned points, Japanese Patent Publication Open to Public Inspection (hereinafter referred to as JP OPI Publication) Nos. 59-78893/1984, 59-109394/1984 and 60-2398/1985 disclose the image forming processes in which a chelation-type thermal-diffusible dye is used, so that an image may be formed, by the resulting chelated dye, on an image-receiving sheet for thermal-transfer recording use.

Although the above-given image-forming processes may be excellent as the processes for improving a heat resistance and a fixing property, the light fastness and image-bleeding resistance of the resulting image in storage have not been satisfactory.

As disclosed in JP OPI Publication No. 59-158287/1984, 63-74686/1988, 63-145089/1988, 59-196292/1984, 62-229594/1987, 63-122596/1988, 61-283595/1986, 1-171887/1989 and 1-204788/1989, the proposals have been made therein for adding the UV absorbent and light stabilizer into the image-receiving layer with the purpose of improving the light fastness of an image. However, when making use of the compounds described therein, the compounds may be colored or the light fastness of the resulting image and the heat stability of the compounds are not satisfactory.

Among the cases of the above-mentioned proposals, in the case of using a light stabilizers of the metal complex salt type as described in JP OPI Publication Nos. 63-122596/1988 and 1-171887/1989 and in the case of the image forming processes in which an image is formed by the chelated dyes as described in JP OPI Publication Nos. 59-78893/1984, 59-109394/1984 and 60-2398/1985, a coloration is produced when trying the combination use of an ordinary organic UV absorbent, because the UV absorbent and the metal ions are chelated together.

JP OPI Publication Nos. 63-193884/1988, 63-194981/1988, 1-208293/1989, 1-280529/1989, 1-283191/1989, 2-139551/1990, 2-252585/1990 and 2-265793/1990 and Japanese Patent Examined Publication (hereinafter referred to as JP Examined Publication) No. 3-9878/1991 propose each that an image preservability is to be improved by covering an image-recorded image-receiving layer surface with a covering film or a resin layer. In these proposals, however, there still remain the following difficulties. An image is bled when covering with a protective material; the light fastness of an image covered with a protective material and the bleeding resistance of a stored image are not satisfactory; and an image quality may not be maintained in forming the image. Even in the other cases, a coloration is similarly produced when making metal ions present as described before.

SUMMARY OF THE INVENTION

This invention has been made on the basis of the above-mentioned circumstances. It is an object of the invention to provide an image-receiving sheet for thermal-transfer recording use, an image-protective material, an image-protecting method and an image-recording material each excellent in image preservabilities including particularly light-fastness and bleeding resistance.

wherein reference numeral

Figure 1:
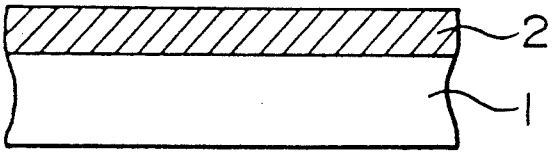
[FIG. 1] A cross-sectional view showing the basic constitution of a protective sheet.

1:a support,

2:an adhesive layer,

3:a protective layer,

4:a peelable layer, and

5:a backing layer

DETAILED DESCRIPTION OF THE PREFERRED EMBODIMENT

For achieving the above-mentioned object of the invention, the 1st embodiment is an image-receiving sheet comprising a support bearing thereon an image-receiving layer containing a resin dyeable to a thermally diffusible dye (hereinafter referred to as an image-receiving layer binder) and an inorganic oxide capable of absorbing UV rays; that is an image-receiving sheet comprising an adhesive layer containing an inorganic oxide, which is interposed between the image-receiving layer and the support; that is also an image-receiving sheet comprising a support containing an inorganic oxide capable of absorbing UV rays; and that is particularly an image-receiving sheet comprising an image-receiving layer containing metal ions for forming a chelated dye image with the use of a chelatable thermally diffusible dye, wherein an inorganic oxide capable of absorbing UV rays is further contained.

It is desirable that the above-mentioned inorganic oxide capable of absorbing UV rays is the fine powder of titanium oxide and/or zinc oxide having a particle size of not larger than 200 nm.

The 2nd embodiment is an image-protective sheet containing the transparent fine powder of titanium oxide and/or zinc oxide capable of absorbing UV rays, which is laminated on the image-receiving layer surface of an image-recorded image-receiving sheet for thermal-transfer recording use so that the image may be protected, and the method for protecting the above-mentioned image.

The 3rd embodiment is an image-protective material comprising an image-protective layer containing the transparent fine powder of titanium oxide and/or zinc oxide capable of absorbing UV rays, which is transferred to the image-receiving layer surface of an image-recorded image-receiving sheet for thermal-transfer recording use so that the image may be protected, and the method for protecting the above-mentioned image.

The 4th embodiment is an image-recording material comprising a protective layer formed on the image-receiving layer of an image-recorded image-receiving sheet for thermal-transfer recording use and a hardened resin layer formed thereon, wherein the fine powder of titanium oxide and/or zinc oxide capable of absorbing UV rays are contained in at least either one of the protective layer and the hardened resin layer; and the method for protecting the above-mentioned image.

In the above-mentioned 1st, 2nd, 3rd and 4th embodiments, it is desired to contain a light stabilizer in at least one each of the layers.

The 1st Embodiment (1) Image-receiving sheet for thermal-transfer recording use The image-receiving sheet for thermal-transfer recording use relating to the invention basically comprises a support laminated thereon with an image-receiving layer containing an image-receiving layer binder and an inorganic oxide capable of absorbing UV rays.

There is no special limitation to the supports for the image-receiving sheets of the invention, but any supports may be used, provided that various materials, layer arrangements and sizes thereof may suitably be selected to meet the purposes of the application. The supports include, for example; various kinds of paper such as paper, coated paper and synthetic paper (e.g., those made of polypropylene or polystyrene and a composite material pasted with paper); a single layered or two or more layered various plastic films or sheets (such as a vinyl chloride type resin sheet, an ABS resin sheet, a polyethylene terephthalate base film, a polyethylene naphthalate base film, a polyacrylate base film, a polycarbonate base film, a polyether ether ketone base film, a polysulfone base film, a polyether sulfone base film, a polyether imide base film and a polyimide base film); films or sheets formed with various kinds of metals; films or sheets formed with various kinds of ceramics; or a composite material laminated with a suitable combination of the above-given materials.

In such a case of requiring a transparency as in applying it to a transmission-type original such as those for an OHP or in sealing it by pasting on a glass plate, the support are desired to have a high transparency. In the case of a reflection-type image, it is desired to add to the support with a white pigment such as titanium white, magnesium carbonate, zinc oxide, barium sulfate, silica, talc and calcium carbonate so that the sharpness of a resulting image can be enhanced.

The thickness of the support is to be within the range of, normally, 20 to 1000 μm and, desirably, 20 to 800 μm. The thickness thereof is suitably selected from the above-given range.

The foregoing image-receiving layer may basically be formed of an image-receiving layer binder and an inorganic oxides capable of absorbing UV rays. If required, a light stabilizer and a surface lubricant may be compounded therein. In the invention, it is desired to compound the light stabilizer and the surface lubricant therein.

Further, the image-receiving layer compounded with a metal ion-containing compound is particularly desirable in the case where a chelatable thermally diffusible dye is used as a transfer dye.

When an image-receiving layer is formed by containing an inorganic oxide capable of absorbing UV rays and a metal ion-containing compound therein, the resulting image-receiving sheet can display the effects of providing a high transfer density, a high image preservability of the thermally diffusible dyes and, particularly, the excellent effects of providing a light fastness and a bleeding prevention. For displaying the above-mentioned effects, the suitable materials are selected out of the materials such as an inorganic oxide capable of absorbing UV rays, a metal ion-containing compound and an additive (such as a light stabilizer and a surface lubricant) or the composite amounts thereof and the image-receiving layer thickness are adjusted.

As for the image-receiving layer binders, any well-known resins may be used. These resins include, for example, a polyvinyl chloride resin, a copolymer resin of vinyl chloride and the other monomer (such as isobutyl ether and vinyl propionate), a polyester resin, poly(-metha)acrylate, polyvinyl pyrrolidone, a polyvinyl acetal type resin, polyvinyl alcohol, polycarbonate, cellulose triacetate, polystyrene, a copolymer of styrene and the other monomer (such as acrylate, acrylonitrile and ethylene chloride), a polyurethane resin, a polyamide resin, a urea resin, an epoxy resin, a phenoxy resin, a polycaprolactone resin, a polyacrylonitrile resin and the modified matters thereof.

Among the above-given resins, the desirable resins capable of satisfying the objects of the invention include, for example, a polyvinyl chloride resin, a copolymer of vinyl chloride and the other monomer, a polyester resin, a polyvinyl acetal type resin, polystyrene, a copolymer of styrene and the other monomer and an epoxy resin. These resins may be used independently or in combination upon mixing them up. Though it is also allowed to use these resins upon newly preparing them, the commercial products thereof available on the market may further be used.

When forming an image-receiving layer, each of the resins may be cross-linked or hardened with radioactive rays, heat, moisture or a catalyst upon utilizing the reaction active site of the resins (if the resins have no reaction active site, the reaction active site is provided to the resins.) In this case, a radioactive monomer such as epoxy and acryl and a cross linking agent such as isocyanate may be used. These monomers and cross-linking agents may be added as they are to an image-receiving layer or they may also be added thereto upon sealing them in a capsules.

The image-receiving sheets of the invention contain an inorganic oxide capable of absorbing UV rays as well as the foregoing image-receiving layer binders. The inorganic oxides capable of absorbing UV rays include, desirably, those having an absorption range of not longer than 400 nm in the UV spectral region. Therefore, the inorganic oxides include, for example, a single kind of metal oxides such as particle size-adjusted titanium oxide and/or zinc oxide, magnesium oxide, tin oxide, indium oxide and silica oxide, ITO or ceramics, and two or more kinds of metal-containing oxides which contain a rare metal applicable to a superconductor.

Among the above-mentioned inorganic oxides capable of absorbing UV rays, it is desired that those having an particle size adjusted to be not larger than 200 nm that is one half of the wavelength of visible rays, because they can be transparent when forming an image-receiving layer. In the invention, the transparent fine powder of titanium oxide and/or zinc oxide having a particle size of not larger than 200 nm may be desirably used and those having a particle size adjusted to be not larger than 50 nm may be preferably used.

The contents of titanium oxide and/or zinc oxide are within the range of desirably 0.5 to 60 wt % and preferably 1 to 50 wt % to the whole amount required for forming an image-receiving layer.

In the image-receiving sheets of the invention, it is desired to contain a light stabilizer and a surface-lubricant in the image-receiving layer thereof. The light stabilizers include, for example, the compounds given in JP OPI Publication Nos. 59-158289/1984, 59-1821785/1984, 60-130735/1985, 61- 229594/1986, 63-122596/1988, 63-145089/1988, 1-171887/1989, 1-204788/1989, 2-276683/1990, 3-19893/1991 and 3-147892/1991, those well-known for improving an image durability in photographic or other image recording materials.

The above-mentioned surface-lubricants can improve the surface lubricity between an ink sheet and an image-receiving sheet. The surface-lubricants include, for example; silicone oil (including the so-called silicone resin); solid waxes such as polyethylene wax, amide wax and Teflon powder; and a surfactant of the fluorine type or the phosphoric acid ester type. Among those, silicone oil is desirably used. The silicone oil include those of the simple adding type and the hardening or reacting type (that is the hardening reaction type).

In the case of the simple adding type, a denatured silicone oil (such as a polyester-denatured silicone resin, a urethane-denatured silicone resin and an acryl-denatured silicone resin) is desirably used for improving the compatibility to binders. The amounts of adding these simple adding type silicone oil may not be determined by one and single rule because the amounts thereof may sometimes be varied by the kinds of the silicone oils. However, generally, the amounts thereof is within the range of, normally, 0.1 to 50 wt % and, desirably, 0.5 to 20 wt % of the image-receiving layer binders used.

The hardening reaction type silicone oil include, for example, those of the reaction-hardenable type (such as those comprising amino-denatured silicone oil and epoxy-denatured silicone oil each reaction-hardened); those of the light-hardenable type; and those of the catalyst-hardenable type. The amount of adding these hardenable type silicone oils is within the range of desirably 0.5 to 30 wt % of the image-receiving layer binders used.

It is also allowed that a surface-lubricant layer may be provided by dissolving or dispersing the above-mentioned surface lubricant in a suitable solvent and coating the resulting solution or dispersion on a part of the surface of an image-receiving layer and then by drying the layer coated thereon.

In the invention, when making use of a chelatable thermally diffusible dye and forming an image on an image-receiving sheet with the chelated dye, the image-receiving layer of the sheet further contains a metal ion-containing compound (hereinafter referred to as a metal source).

The metal sources include, for example, the inorganic or organic salts of metal ions and the metal complexes. Among them, an organic acid salt and the complexes thereof may preferably be used. The typical examples of this kind of metal sources include those exemplified in U.S. Pat. No. 4,987,049.

The metal sources may be added in an amount within the range of, normally, 1 to 60 wt % and, preferably, 10 to 40 wt % of an image-receiving layer forming material used.

To the image-receiving layer, it is also allowed to add an antioxidant, a filler (made of inorganic fine particles or organic resin particles) and a pigment. It is further allowed to add thereto a plasticizer and a thermally fusible material each as a sensitizer.

The antioxidants include, for example, those described in JP OPI Publication Nos. 59-182785/1984, 60-130735/1985 and 1-127387/1989 and the well-known compounds capable of improving an image durability in photographic or other image-recording materials.

The fillers include, for example, inorganic fine particles and organic resin particles. The inorganic fine particles include, for example, those of silica gel, calcium carbonate, titanium oxide, zinc oxide, acid clay, activated clay and alumina. The organic fine particles include, for example, resin particles such as fluoro-resin particles, guanamine-resin particles, acryl-resin particles and silicone-resin particles. These inorganic or organic resin particles may desirably be added in a proportion within the range of 0 to 30 wt %, depending on the variations of the specific gravity thereof.

The typical examples of the pigments include titanium white, calcium carbonate, zinc oxide, barium sulfate, silica, talc, clay, kaolin, activated clay and acid clay.

The plasticizers include, for example, a phthalic acid ester, a trimellitic acid ester, an adipic acid ester, and, besides, a saturated or unsaturated carboxylic acid ester, a citric acid ester, epoxidated soybean oil, epoxidated linseed oil, an epoxystearic acid epoxy, an orthophosphoric acid ester, a phosphorous acid ester and a glycol ester.

The examples of the foregoing thermally fusible materials include, typically; the following monomolecular compounds, namely, alcohol such as terpineol, menthol, 1,4-cyclohexane diol and phenol, amides such as acetamide and benzamide, esters such as coumarin and benzyl cinnamate, ethers such as diphenyl ether and crown ether, ketones such as camphor and p-methyl acetophenone, aldehydes such as vanillin and dimethoxy benzaldehyde, hydrocarbons such as norbornane and stilbene, higher aliphatic acids such as margaric acid, a higher alcohol such as eicosanol, higher aliphatic acid esters such as palmitic acid cetyl, higher aliphatic acid amides such as stearic acid amide, and higher amines such as behenyl amine; the following macromolecular compounds, namely; wax such as carnauba wax, beeswax, paraffin wax, ester wax, montan wax and amide wax, rosin derivatives such as ester gum, rosin-maleic acid resin and rosin-phenol resin, phenol resin, ketone resin, epoxy resin, diallyl phthalate resin, terpene resin, aliphatic hydrocarbon resin, cyclopentadiene resin, polyolefin resin, polyethylene glycol and polyolefin oxides such as polypropylene glycol; and so forth.

In the invention, the above-mentioned thermally fusible materials are desirable to have a softening point within the range of 10° to 150° C.

In the invention, all the additives are desirable to be added in a proportion selected from the range of, usually, 0.1 to 30 wt % of the resin for the image-receiving layer use.

The thickness of the image-receiving layer is suitable to be selected from the range of, usually, 3 to 30 μm and, desirably, 5 to 20 μm.

The image-receiving layer may be single layered or, if required, it is also allowed to provide with a two or more layered structure having the same or different composition in the layers thereof.

It is further allowed to interpose an interlayer (or a sublayer) between an image-receiving layer and a support, for the purposes of providing with the properties such as heat-insulation property, barrier property, cushion property and adhesive property.

In the invention, it is allowed to contain an inorganic oxide capable of absorbing UV rays in the interlayer. The resins for constituting an interlayer include, for example, a polyurethane resin, a polyester resin, a polybutadiene resin, a poly(metha)acrylic acid ester resin, an epoxy resin, a polyamide resin, a rosin-denatured phenol resin, a terpenephenol resin, an ethylene-vinyl acetate copolymer, a polyolefin type resin, a cellulose type resin, gelatin, casein and so forth.

For the purpose of providing a cushion property, it would be better to contain minute bubbles in the interlayer.

When the layer containing minute bubbles is formed in a coating process, the following methods may be applied, namely; a method in which bubbles are contained in a coating solution by mechanically stirring the solution and the coating is applied and then dried; another method in which a coating solution containing a foaming agent is coated and dried, and the foaming agent is foamed; a further method in which a coating solution containing hollow fine particles is coated and dried; and still further method in which a solvent for dissolving the foregoing resin and another solvent having a boiling point higher than that of the former solvent and an afinity to the former solvent, but not having any solubility to any resins are each mixed up, coated and dried. When the layer containing minute bubbles is formed in a lamination process, the following methods may be applied, namely; a method in which a resin-fused composition containing a foaming agent is laminated on and the coated matter is so heated as to be foamed; another method in which a fused composition containing hollow fine particles is laminated; a further method in which fine particles are contained in a composition for forming an interlayer and a fused composition is extruded and stretched at least uniaxially so as to make a sheet containing minute bubbles, and then the sheet is laminated on a support; and still further method in which, after a component soluble to a solvent and another component insoluble thereto are fusedly kneaded and the kneaded matter is laminated on, the laminated matter is dipped in the solvent so as to dissolve the soluble component. It is also allowed that the sheet-shaped composition which was already foamed in advance may be pasted on by making use of adhesives.

It is also allowed that the surface of an image-receiving layer may be laminated with an overcoat layer such as those made of a silicone type resin, a fluorine type resin or a wax, for the purpose of preventing an ink sheet and an image-receiving sheet from being fused with each other. It is further allowed that a backing layer may be provided to the surface opposite to the image-receiving layer (that is the surface of a support), for the purposes of preventing any electrostaticity, any double paper feeding, any adhesion to other image-receiving layers and curling, providing a slidability and improving a retouchability.

For the purpose of preventing any electrostaticity, it is desired to add into a backing layer with a cationic surfactant, anionic surfactant, a non-ionic surfactant and an antistatic agent such as a macromolecular antistatic agent. For the purposes of preventing any double paper feeding and adhesion to any other image-receiving layers and providing a slidability, it is desired to add the inorganic or organic fine particles described in the article of the additives for image-receiving layers.

For the purpose of preventing any curling, it is desired to use a heat-resistive resin having few thermal deformation or a resin hardened by heat or ionizing radiation after forming a backing layer.

The heat-resistive resins may include, for example, a cellulose type resin such as methyl cellulose and nitrocellulose, a styrene type resin such as polystyrene and a styrene-acrylonitrile copolymer, an acryl type resin such as methyl polymethacrylate and polyacrylate, a polyester type resin such as polyethylene terephthalate, polycarbonate, polyarylate, polyacetal, polysulfone, polyether sulfone, polyether nitrile, polyether etherketone, denatured polyphenylene oxide, polyoxy benzylene, polyimide, polyether imide, polyamidoimide, polyphenylene sulfide and polyparabanic acid resin.

For the purpose of providing a retouchability, it is desired to contain inorganic or organic fine particles.

When providing an interlayer, an overcoat layer and a backing layer, the thicknesses thereof may be suitably selected from the thickness range of, normally, 0.1 to 20 μm.

Each of the above-mentioned layers may be single-layered or, if required, may also have a two or more layered structure having the same or different compositions.

(2) Preparation of an image-receiving sheet

The image-receiving sheets can be prepared in the following processes, namely, a coating process in which a coating solution for image-receiving layer use is prepared by dispersing or dissolving the above-mentioned image-receiving layer forming components into a solvent and the resulting coating solution is coated on the surface of a support and then dried; or a laminating process in which a mixture containing an image-receiving layer forming components is fusedly extruded and the resulting extrusion is laminated on the surface of a support.

The solvents applicable to the above-mentioned coating process include, for example, water, alcohol (such as ethanol and propanol), cellosolve (such as methyl cellosolve and ethyl cellosolve), aromatic solvents (such as toluene, xylene and chlorobenzene), ketones (such as acetone and methylethyl ketone), ester type solvents (such as ethyl acetate and butyl acetate), ethers (such as tetrahydrofran and dioxane) and chlorine type solvents (such as chloroform and trichlorethylene).

For the above-mentioned coating processes, the conventionally known gravure-roll coating process, an extrusion coating process, a wire-bar coating process and a roller coating process may be used.

The above-mentioned image-receiving layers may be formed extending over the whole surface of a support or may be formed on a part of the surface of a support.

(3) Ink-sheet for thermal-transfer recording use

An ink-sheet for thermal-transfer recording use (hereinafter abbreviated to as an ink-sheet) is basically comprised of a support laminated with ink layers thereon.

Any types of the ink-sheet support may be used, provided, they are excellent in dimensional stability and have a heat resistance when making a record with a thermal-head. The ink-sheet supports applicable thereto include, for example, single-weight paper such as condenser paper and glassine paper, and heat-resistive plastic film such as those of polyethylene terephthalate, polyethylene naphthalate, polyamide, polyimide, polycarbonate, polysulfone, polyvinyl alcohol cellophane and polystyrene.

The thickness of such a support as mentioned above is desirably within the range of 2 to 10 μm. There is no special limitation to the configuration of the supports. Therefore, any configurations such as a wide sheet or film, and a narrow tape or card may be used.

The ink-layers contain a thermally diffusible dye and a binder, as the essential components thereof.

The thermally diffusible dyes include, for example, a cyan dye or a cyan-image forming dye, a magenta dye or a magenta-image forming dye, and a yellow dye or a yellow-image forming dye.

The cyan dyes include, for example, the naphthoquinone type dyes, anthraquinone type dyes and azomethine type dyes, which are described in JP OPI Publication Nos. 59-78896/1984, 59-227948/1984, 60-24966/1985, 60-53563/1985, 60-130735/1985, 60-131292/1985, 60-239289/1985, 61-19396/1986, 61-22993/1986, 61-31292/1986, 61-31467/1986, 61-35994/1986, 61-49893/1986, 61-148269/1986, 62-191191/1987, 63-91288/1988, 63-91287/1988, 63-290793/1988 and so forth.

The magenta dyes include, for example, the anthraquinone type dyes, azo dyes and azomethine type dyes, which are described in JP OPI Publication Nos. 59-78896/1984, 60-30392/1985, 60-30394/1985, 60-253595/1985, 61-262190/1986, 63-5992/1988, 63-205288/1988, 64-159/1989, 64-63194/1989 and so forth.

The yellow dyes include, for example, the methine type dyes, azo type dyes, quinophthalone type dyes and anthraisothiazole type dyes, which are described in JP OPI Publication Nos. 59-78896/1984, 60-27594/1985, 60-31560/1985, 60-53565/1985, 61-12394/1986, 63-122594/1988 and so forth.

The particularly desirable thermally diffusible dyes include, for example; an azomethine dye obtained in a coupling reaction of a compound having an open-chain type or closed-chain type active methylene group with the oxidized product of a p-phenylenediamine derivative or the oxidized product of a p-aminophenol derivative; and an indoaniline dye obtained in a coupling reaction of a phenol or naphthol derivative with the oxidized product of a p-phenylenediamine derivative or the oxidized product of a p-aminophenol derivative. The thermally diffusible dyes contained in an ink layer may be any one of yellow, magenta and cyan dyes, provided, an image to be formed is monochromatic. It is also allowed to contain two or more kinds of the above-mentioned three kinds of dyes or other thermally diffusible dyes, according to the color tone of an image to be formed.

In the image-forming process in which chelatable thermally diffusible dyes are so used as to form an image on an image-receiving sheet, by making use of the resulting chelated dyes, the dyes applicable thereto are those capable of forming at least two seats of chelates. Among the dyes, those represented by the following Formula (I) may desirably be used.

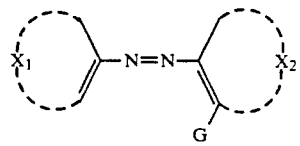

Formula (I)

wherein $X_1$ represents a group consisting of atoms necessary to complete an aromatic carbon ring or a heterocyclic ring of which at least one of the rings comprises 5 to 7 carbon atoms, and at least one of the adjacent positions of the carbon atom bonded to an azo bond has a nitrogen atom or a carbon atom substituted with a chelated group; $X_2$ represents an aromatic heterocyclic ring or an aromatic carbon ring of which at least one of the rings comprises 5 to 7 atoms; and G represents a chelated group.

The typical examples of the dyes are given in JP OPI Publication Nos. 59-78893/1984 and 59-109349/1984, and JP Application Nos. 2-213303/1990, 2-214719/1990 and 2-203742/1990.

The dyes capable of forming at least two seats of chelates, which are applicable to the invention, may be used independently or in combination.

The above-mentioned thermally diffusible dyes are used in a proportion within the range of 10 to 70 wt % of an ink-layer forming materials used and, desirably, 20 to 60 wt % thereof.

The binders for the ink-layers include, for example; cellulose type resins such as cellulose-addition compounds, cellulose esters and cellulose ethers; polyvinyl acetal type resins such as polyvinyl alcohol, polyvinyl formal, polyvinyl acetoacetal and polyvinyl butyral; acryl type resins such as polyvinyl pyrrolidone, polyvinyl acetate, polyacryl amide, styrene type resins, poly(-metha)acrylic acid esters, poly(metha)acrylic acid and (metha)acrylic acid copolymers; rubber type resins; ionomer resins; olefin type resins; and polyester resins.

Among these resins, polyvinyl acetal type resins or cellulose type resins each excellent in preservability may desirably be used. The above-mentioned various kinds of binders may also be used independently or in combination.

The above-mentioned ink layers are further allowed to suitably contain various kinds of additives. Such an additive as mentioned above include, for example; a peelable compound such as silicone resin, silicone oil (including those of the reaction-hardening type), silicone-denatured resins, fluororesin, surfactants and wax; fillers such as metal fine powder, silica-gel, metal oxides, carbon-black and resin fine powder; hardening agents capable of reacting with a binder component (including, for example, radiation-active compounds such as an isocyanate, an acryl and an epoxy); and surfactants such as a cationic, anionic, non-ionic or macromolecular surfactant.

The additives applicable thereto further include, for example, a thermally fusible material for accelerating an image-transfer, such as wax and a higher aliphatic acid ester, and the compounds or polymers described in the paragraph of the heat solvents for the additives for the above-mentioned image-receiving layers.

The ink layers may be single-layered or, if required, may have a two or more layered structure in which the compositions of the layers are the same with or the different from each other.

The ink sheets are not limited to have a two-layered structure comprising a support and an ink layer, but other layers may also be formed thereon. For the purposes of preventing any image-receiving layer from being fused with the sheet or preventing any thermally diffusible dyes from offsetting (or blocking), the ink sheets are also allowed, for example, to provide an overcoat layer comprising a silicone type resin or a fluororesin onto the surface of the sheet.

For the purposes of improving an adhesive property to a binder, preventing a dye from transferring to or dyeing on the support side, a sublayer may be provided to the support. It is also allowed to provide a backing layer to the rear side of the support (or to the opposite side of the ink layer) for the purposes of improving the running stability, heat resistance, dimensional stability and antistatic property.

The thicknesses of the above-mentioned overcoat layer, sublayer and backing layer are usually within the range of 0.1 to 1 μm.

Each of the above-mentioned layers may be single-layered or, if required, they may also have a two or more layered structure of which the compositions are the same with or the different from each other.

(4) Preparation of ink-sheet

The above-mentioned ink sheet can be prepared in the following manner. A coating solution for forming an ink layer is prepared by dispersing or dissolving each kind of the ink layer forming components and the resulting coating solution is coated on the surface of a support and then dried up.

The above-mentioned binders are used upon dissolving one or more of them in a solvent or dispersing them latexwise. The solvents may include, for example, water, ethanol, tetrahydrofran, methylethyl ketone, toluene, xylene, chloroform, dioxane, acetone, cyclohexane and butyl acetate.

The above-mentioned coating can be carried out in the conventionally known gravure-roll successive surface-coating process, an extrusion coating process, a wire-bar coating process or a roller coating process.

The ink layer may be provided in the form of a layer containing a monochromatic thermally diffusible dye onto the whole or a part of a support surface, or a binder and a yellow-ink layer containing a yellow-image forming dye, a binder and a magenta-ink layer containing a magenta-image forming dye, and a binder and a cyan-ink layer containing a cyan-image forming dye may be each provided along the planer direction in constant repetitions onto the whole of a part of the support surface.

In addition to the above-mentioned three ink layers arranged along the planer direction, a black-ink layer containing a black-image forming material may be interposed among the three layers. Whenever the black-ink layer is either of the diffusion-transfer type or the fusion-transfer type, a sharp image can be provided.

The thicknesses of the resulting ink layers are within the range of, usually, 0.2 to 10 μm and, desirably, 0.3 to 3 μm.

The ink sheet may be made convenient for practical use when the sheet is perforated or putting a detection-mark for detecting the positions of various hues.

(5) Formation of images (Thermal-transfer recording)

An image may be formed in the following manner. The ink layer of an ink sheet and the image-receiving layer of an image-receiving sheet are overlapped together and heat energy is applied to the interface between the ink layer and the image-receiving layer. Thereby the thermally diffusible dyes contained in the ink layer are evaporated or sublimated as much as an amount corresponding to the heat energy and the dyes are transferred to and received on the image-receiving layer side, so that the image can be formed on the image-receiving layer.

An image-receiving sheet comprising an image-receiving layer of the invention containing an inorganic oxide capable of absorbing UV rays and a compound containing metal ions, such image-receiving sheet can display the excellent effects on a high transfer density, the high image-preservability of thermally diffusible dyes and, particularly, on light-fastness and prevention of any bleeding.

As for the heat-sources for applying heat energy, a thermal head is generally used and, besides, any known heat-sources such as a laser beam, an infrared flash light and a heat-pen may also be used.

When making use of the above-mentioned thermal-head as a heat source, heat energy to be applied may be varied continuously or multistepwise by modulating an voltage or a pulse width to be applied to the thermal-head.

When making use of a laser beam as a heat source, a heat energy to be applied can be varied by varying the quantity or area irradiated by the laser beam. In this case, it is advisable to make present a laser beam absorbing material (such as carbon-black and an infrared absorbing material in the case of a semiconductor laser) in or around the neighborhood of an ink layer. When making use of a laser beam, it is further advisable to bring an ink sheet into close contact with an image-receiving sheet.

When making use of a built-in photo-acoustic element dot-generator, any heat energies corresponding to any half-tone sizes can also be applied.

When making use of an infrared flash light as a heat source, it would be better to apply heat through a colored layer such as a black layer as same as in the case of using a laser beam. It is also allowed to apply heat through a pattern having a continuous gradation of an image or through a half-tone pattern. It is further allowed to apply heat through a combination of a colored layer blackened on the whole surface and a negative pattern corresponding to the negative of the above-mentioned pattern.

A heat energy may be applied from the ink sheet side, the image-receiving sheet side or the both sides thereof. From the viewpoint of effectively utilizing heat energy in preference to others, it is desired to apply heat energy from the ink sheet side.

A monochromatic image can be recorded on the image-receiving layer of an image-receiving sheet in the above-described thermal-transfer recording procedures. In addition to the above, a color image having color-photographic tones produced of the combination of each color can also be obtained.

For example, when carrying out every thermal-transfer corresponding to each color by changing the thermally yellow, magenta and cyan sensitive sheets and, if required, a thermally black sensitive sheet, respectively, a color image having a photographic color tone produced of the combination of each color can also be obtained.

It is also effective to use a method in which an ink sheet having an area formed in advance by separately coated in each color in place of making use of the above-mentioned ink sheets of each color. To be more concrete, there adopts the method in which, first, a separated yellow image is thermally transferred by making use of a yellow area; second, a separated magenta image is thermally transferred by making use of a magenta area; and so forth by repeating the above-mentioned procedures in order so that the yellow, magenta and cyan separated images and, if required, a black separated image are thermally transferred in order. A color image having a color-photographic tones can be obtained in this method and, to be more convenient, this method has a further advantage that any thermally sensitive sheets are not necessarily replaced.

After forming an image in the above-described method, a heating treatment may also be carried out in the above-mentioned method for the purpose of improving an image preservability. For example, an area where any ink layer of an ink sheet is not provided may be heated extending over the whole image-formed surface with a thermal head, or the area may also be heated anew with a heat-roll. When a near-infrared absorbent is contained therein, it is also allowed to expose an image forming surface to an infrared flash lamp.

In any cases, there is no limitation to the heating means applicable thereto. However, it is desired to heat from the direction of the support side of an image-receiving layer, because it is effective to satisfy the purpose of further diffusing dyes into the image-receiving layer.

The 2nd Embodiment

The images to be protected by a protective sheet may be any one of conventionally sublimatable type thermal-transfer images, those formed in the 1st embodiment and images such as a photograph and a printed image.

(1) Protective sheet

The protective sheet applicable to the invention can be comprised of support 1 and adhesive layer 2 as shown in FIG. 1 attached hereto. The protective sheet has no special limitation to the structures thereof, provided, the sheet can cover an image formed on an image-receiving layer.

In the invention, support 1 and/or adhesive layer 2 of the protective sheet each contain the fine powders of transparent titanium oxide and/or zinc oxide capable of absorbing UV rays. The configurations and natures of the fine powders of titanium oxide and/or zinc oxide are the same as those described in the foregoing 1st embodiment.

The resins constituting a support include, for example, a vinyl chloride type resin, a styrene type resin, polyethylene terephthalate, polybutylene terephthalate, polyethylene naphthalate, polyallylate, polycarbonate, polyether ether ketone, polysulfone, polyether sulfone and polyether imide. These resins can be used for preparing a film or sheet in any known methods.

For example, the fine powders of titanium oxide and/or zinc oxide capable of absorbing transparent UV rays are fusedly kneaded and the resulting composition is extruded from a molding machine and is then prepared in the form of film in an inflation process, a flat-film process or a T-dye process. After that, the resulting film is nip-roll-stretched or stretched monoaxially or biaxially, so as to prepare a film or sheet having a specific thickness and containing transparent titanium oxide and/or zinc oxide capable of absorbing UV rays.

The film or sheet resins containing transparent titanium oxide and/or zinc oxide capable of absorbing UV rays, which are prepared in the above-mentioned process, such a resin may be single-, double- or multi-layered by simultaneously extruding the resins.

The fine powders of titanium oxide and/or zinc oxide may be added in a proportion within the range of, desirably, 0.1 to 50 wt % of the whole amount of the support forming components and, preferably, 0.1 to 20 wt % thereof.

In the invention, there is no special limitation to the thickness of the support used, but is usually within the range of 10 to 100 μm.

In the invention, an adhesive layer is allowed to contain the fine powders of transparent titanium oxide and/or zinc oxide capable of absorbing UV rays. The configurations of natures of the fine powders of titanium oxide and/or zinc oxide used therein are the same as those described in the foregoing the 1st embodiment. The proportion of the fine powders of transparent titanium oxide and/or zinc oxide capable of absorbing UV rays, which are to be contained in the adhesive layer, is desirably within the range of 0.1 to 50 wt % of the whole component for forming the adhesive layer.

The above-mentioned adhesive layer can be formed, for example, by mixing a resin having a low softening point and a thickener with a thermofusible material and/or a thermoplastic material. The adhesive layer may also be formed by coating a thickener compositions on the surface of a resin layer comprising a thermofusible material and/or a thermoplastic material. Or, the adhesive layer may further be formed by containing a thickening material being sealed in a microcapsule in any known method in a resin layer comprising a thermofusible material and/or a thermoplastic material.

The resins having a low softening point applicable to the adhesive layers include, for example; an ethylene type copolymer such as those of ethylene-vinyl acetate and ethylene-ethyl acrylate; a polyamide type resin such as Nylon; a polystyrene type resin such as styrene-butadiene, styrene-isoprene, and styrene-ethylene-butylene; a polyester type resin; a polyolefin type resin; a polyvinyl ether type resin; a polymethyl methacrylate type resin; an ionomer resin; a cellulose type resin; a polyurethane type resin; an acryl type resin; an epoxy type resin; a melamine type resin; and a vinyl chloride type resin.

The thickeners include, for example; an undenatured or denatured rosin type thickener such as a rosin thickener, a hydrogenated rosin type thickener, a rosin maleic acid type thickener, a polymerized rosin type thickener and a rosin phenol type thickener; a terpene type thickener; a petroleum resin type thickener; and the denatured thickeners thereof.

The thermofusible materials allowed to be contained in an adhesive layer are the same as those allowed to be contained in the image-receiving layer of the foregoing 1st embodiment.

In the invention, it is desired to contain a light stabilizer in the support and/or adhesive layer of a protective sheet. The light stabilizers applicable thereto are the same as those allowed to be contained in the image-receiving layer of the 1st embodiment. Further, it is also allowed to add an additive such a the antioxidant allowed to be used in the 1st embodiment.

The above-mentioned adhesive layer can be formed by adopting, for example, a coating process in which a solvent is used and a hot-melt coating process. The thickness of the resulting adhesive layer is within the range of, usually, 0.5 to 20 μm and, desirably, 1 to 10 μm.

(2) Transfer of a protective sheet

As for the means of laminating a protective sheet on the surface of an image-receiving layer formed thereon an image, any conventional means may be used as they are. For example, these means include a thermal-head, a heat-pressure roll and a hot-stamp each used when forming an image. The lamination can be performed by varying the temperature or pressure of these means according to the difference between the resin of an image receiving layer and the resin of an adhesive layer.

The 3rd Embodiment

The images to be protected with a protective layer may include any conventional sublimation type thermal-transfer images, the images formed in the 1st embodiment or those of photographs or prints.

(1) Sheet for protective layer-transfer use

Figure 2:
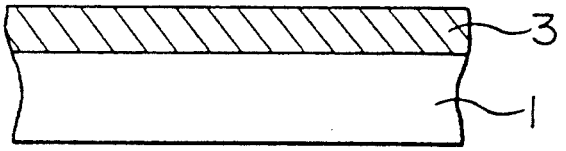
[FIG. 2] A cross-sectional view showing the basic constitution of a protective layer-transfer sheet.

The protective layer-transfer use applicable to the invention can be basically comprised of support 1 and protective layer 3 as shown in FIG. 2 attached hereto. There is no special limitation to any structures of the above-mentioned sheet for protective layer-transfer use, as far as the subject protective layer having a specific area and a specific configuration has such a structure that the protective layer may be peeled out of a support so as to adhere to an image-receiving layer by a suitable means such as a heating means when transferring the protective layer.

In order to peel the above-mentioned image-receiving layer of the protective layer-transferring sheet away from a support when making a transfer, it is necessary that the adhering strength of the support to the protective layer should be smaller than that of the protective layer to the image-receiving layer. For satisfying the above-mentioned purpose, it is advisable that a binder constituting the protective layer is suitably selected, a peeling agent is added to a protective layer, or an adhesive layer and a peelable layer may be combined together to meet the basic constitution shown in FIG. 2.

Figure 3:
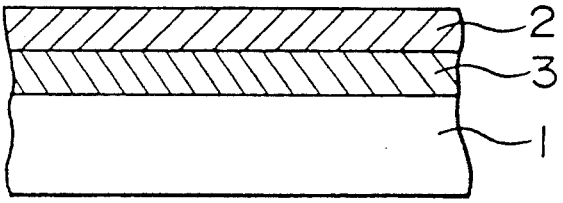
[FIG. 3] A cross-sectional view of a protective layer-transfer sheet laminated with an adhesive layer.
Figure 4:
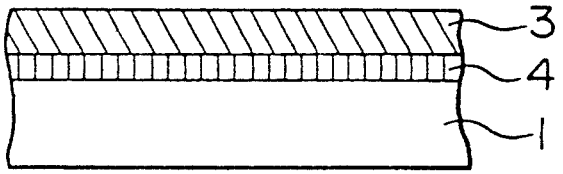
[FIG. 4] A cross-sectional view of a protective layer-transfer sheet provided with a peelable layer.
Figure 5:
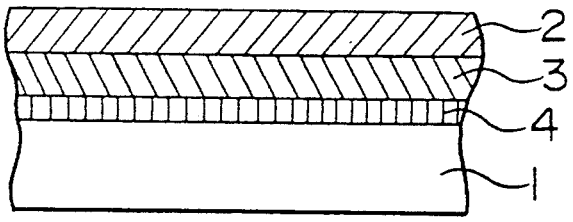
[FIG. 5] A cross-sectional view of a protective layer-transfer sheet provided with a peelable layer and laminated with an adhesive layer.

As shown in FIG. 3, adhesive layer 2 may be laminated on protective layer 3 above support 1. As shown in FIG. 4, peelable layer 4 may be interposed between support 1 and protective layer 3. Further, as shown in FIG. 5, peelable layer 4, protective layer 3 and adhesive layer 2 may be laminated in this order on support 1. Though no figure is shown, a backing layer may also be provided to the rear side of the support of the sheet for protective layer-transfer use of the invention, with the purposes of maintaining a dimensional stability, running stability and heat resistance and preventing any staticity.

Figure 6:
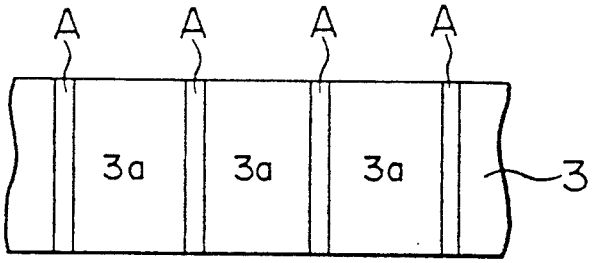
[FIG. 6] A top plan view of a protective layer-transfer sheet provided with a protective layer sectioned by spaced boundaries.

The protective layer may be suitably provided in advance with a slit or a space. For transferring a protective layer to be the same size as that of an image-receiving sheet, for example, it is convenient, as shown in FIG. 6, that a slit or space A is provided to the surface of protective layer 3 so as to be at right angles to the longitudinal surface direction and the surface of protective layer 3 is partitioned into plural sections 3*a* each having the same area as the surface area of a subject image recording material.

As for the supports applicable thereto, any materials excellent in dimensional stability and heat resistance when an image-receiving layer is transferred by a thermal head. Therefore, they include, for example; a single-weight (or thin-leaf) paper such as condenser paper and a glassine paper; various plastic films or sheets such as those made of polypropylene, polyethylene terephthalate, polyethylene naphthalate, polyamide, polycarbonate, polysulfone, polyvinyl alcohol, cellophane, polystyrene or fluororesin; a film or sheet made of various metals; and a film or sheet made of various ceramics. There is no special limitation to the thicknesses of the supports, but the thicknesses thereof are usually within the range of 5 to 50 μm.

The above-mentioned protective layer is basically formed of a binder for protective layer use and the fine particles of the foregoing transparent titanium oxide and/or zinc oxide capable of absorbing UV rays. The resulting protective layer is allowed to contain a surface-lubricant and also to contain a metal-ion-containing compound contained in the image-receiving layer of the 1st embodiment and, if required, various additives. The thickness of a protective layer formed on a support is within the range of the order of, generally, 1 to 20 μm and, desirably, 3 to 10 μm.

As for the binders for protective layer use, any well-known resins may be used. These resins include, for example, vinyl chloride type resin, polyester type resin, acryl type resin, polyvinyl acetal type resin, polyvinyl alcohol, polycarbonate, polyallylate, cellulose type resin, styrene type resin, urethane type resin, amide type resin, urea type resin, epoxy resin, phenoxy resin, polycaprolactone resin, polyacrylonitrile resin and the denatured products thereof.

Among the above-given resins, those desirably applicable to the invention include, for example, vinyl chloride type resin, polyester type resin, acryl type resin, polyvinyl acetal type resin, styrene type resin, epoxy resin and phenoxy resin. These resins may be used independently or in combination.

The desirable configurations and natures of the fine particles of transparent titanium oxide and/or zinc oxide capable of absorbing UV rays are the same as those described in the foregoing 1st embodiment. The fine particles of titanium oxide and/or zinc oxide contained in a protective layer may be used in a proportion desirably within the range of 0.1 to 50 wt % of the whole amount for forming a resin layer.

In the invention, a light stabilizer is desired to be added into a protective layer. The light stabilizers added therein are the same as those allowed to be contained in the image-receiving layer of the 1st embodiment.

For the purpose of making a protective layer easily peelable from the support of a protective layer-transfer sheet, a surface-lubricant may be added into the protective layer. The surface-lubricants are the same as silicone oil (including those so-called silicone resins) serving as a surface-lubricant to be added in the image-receiving layer of the foregoing 1st embodiment.

The above-mentioned metal ion-containing compounds are the same as those described in the foregoing 1st embodiment.

The protective layers are allowed to contain an antioxidant and a light stabilizer. The compounds desirable therefor are the same as those added to the image-receiving layer of the foregoing 1st embodiment.

In the invention, the whole amount of the additives to be added is desirably selected from the proportion within the range of 0.1 to 30 wt % of the resins for protective layer use.

The materials for forming a peelable layer include, for example, silicone resin, denatured silicone resin, silicone oil, fluororesin and the hardened materials thereof.

The thickness of the peelable layer is within the range of, generally, 0.03 to 2.0 μm and, desirably, 0.1 to 1.0 μm.

The adhesive layer can be formed of the same materials as described in the foregoing 2nd embodiment.

(2) Preparation of a sheet for protective layer-transfer use

A sheet for protective layer-transfer use can be prepared in a coating process in which a coating solution for coating a protective layer is prepared by dispersing or dissolving the components of forming a protective layer in a solvent and the resulting coating solution for coating a protective layer is coated on the surface of the foregoing support and is then dried up; or, the same sheet can also be prepared in a lamination process in which a mixture containing the components for forming a protective layer is fusedly extruded and the resulting extruded matter is laminated on the surface of a support.

The solvents applicable to the above-mentioned coating process include, for example, the conventionally known solvents such as water, alcohol, methylethyl ketone, toluene, dioxane and cyclohexane.

When applying the above-mentioned lamination process, it is also allowed to use a co-extrusion process.

The protective layer may be formed extending over the whole surface of a support or may also be formed on a part of the surface of the support.

Also in the case where a peelable layer is interposed between a protective layer and a support, the protective layer can be provided in the same manner as in the above-described protective layer forming manner. When this is the case, the protective layer may be laminated after providing the peelable layer. Further, in the case where an adhesive layer is provided onto a protective layer, the protective layer can be provided in the same manner as in the foregoing manner for forming the protective layer and peelable layer. When this is the case, the adhesive layer may be laminated after the protective layer is provided.

(3) Protective layer transfer from a protective layer-transfer sheet

A protective layer can be transferred from a protective layer transfer sheet in the same manner as in the 2nd embodiment.

The 4th Embodiment

After forming a protective layer on an image-receiving layer, another substantially transparent hardened protective layer, which was hardened by irradiating ionizing radiation rays, may be further formed extending over the whole surface of the image-receiving layer having the former protective layer so as to enhance the protection. The protective layer for the image-receiving layer having the former protective layer may be formed in the manner described in the 3rd embodiment or may be those not containing any transparent titanium oxide and/or zinc oxide capable of absorbing UV rays. The hardened resin layer may desirably be hardened by UV rays, because the hardening can readily be performed and the devices can be simplified. The UV-hardened resin layer can be prepared by applying a coating agent containing a UV-hardenable resin onto the base material and then by irradiating UV rays to the coated matter.

The above-mentioned coating agent can be prepared of a composition containing a UV-hardenable prepolymer and a polymerization initiator as the principal components.

The UV-hardenable prepolymers include, for example, those containing two or more epoxy groups in a single molecule and those containing one or more acryl groups in a single molecule. Among them, those having an epoxy group is desirable from the viewpoint of handling convenience. These prepolymers include, for example; the hydrogenated compounds such as alicyclic polyepoxides, the polyglycidyl esters of a polybasic acid, the polyglycidyl ethers of a polyhydric alcohol, the polyglycidyl ethers of a polyalkylene glycol and the polyglycidyl ethers of an aromatic polyol; a urethane polyepoxy compound; and an epoxidated polybutadiene. These prepolymers may be used independently or in combination in the form of a mixture thereof.

In the coating agents, the prepolymer having two or more epoxy groups in one molecule may desirably be contained in a proportion of not less than 70 wt %.

As for the foregoing polymerization initiators, a cationic polymerization initiator may desirably be used, and they include, typically, an aromatic onium salt. The aromatic onium salts may include, for example; the salts of the elements belonging to Group Va categorized in the periodic table, such as a phosphonium salt (e.g., triphenyl phenacyl phosphonium hexafluorophosphate); the salts of the elements belonging to Group VIa, such as a sulfonium salt (e.g., triphenyl sulfonium tetrafluoroborate, triphenyl sulfonium hexafluorophosphate, tris(4-thiomethoxyphenyl)sulfonium hexafluorophosphate and triphenyl sulfonium hexanfluoroantimonate) and the salts of the elements belonging to Group VIIa such as an iodonium salt (e.g., diphenyl iodonium chloride).

U.S. Pat. Nos. 4,058,401, 4,069,055, 4,101,513 and 4,161,478 detailedly describe of the application of the above-mentioned aromatic onium salts as a cationic polymerization initiator when polymerizing an epoxy compound.

The desirable cationic polymerization initiators include, for example, the sulfonium salts of the elements belonging to Group VIa of the periodic table. Among them, triaryl sulfonium hexafluoroantimonate is desired from the viewpoints of UV-hardening property and the storage stability of the UV-hardenable compositions.

In the coating agents, the cationic polymerization initiator are contained therein in a proportion within the range of, desirably, 3 to 20 wt % and, preferably, 5 to 12 wt %. When a cationic polymerization initiator content does not exceeding 1 wt %, it is not desirable because there may be some instances where the hardening speed is exceedingly slowed down when UV rays are irradiated.

The UV-hardenable resins include, for example, not only the above-mentioned epoxy type hardenable resins without limitation, but a radically polymerizable resin such as a monofunctional or polyfunctional acrylate compound.

The coating agents are also allowed to contain, for example, oils (including particularly silicone oil); a surfactant including a silicone-alkylene oxide copolymer (such as L-541 available from Union-Carbide Co.); a silicone oil-containing aliphatic epoxide; a fluorocarbon surfactant such as FO-171 and FO-430 each available from 3M Co. and Megafac F-141 available from Dai-Nippon Ink Co.

The coating agents are also allowed to contain, for example; a vinyl or cellulose type monomer such as styrene, paramethyl styrene, methacrylic acid esters and acrylic acid esters; and a monoepoxide such as thermoplastic polyesters, phenyl glycidyl ether, silica-containing monoepoxide and butyl glycidyl ether; provided that the effects of the invention shall not be spoiled.

The coating agents are further allowed to contain, for example; transparent titanium oxide and/zinc oxide capable of absorbing UV rays as the inert components thereof. Beside, a light stabilizer, an antioxidant, a thickener, a plasticizer, a levelling agent, a coupling agent, an adhesive and other various additives may also be contained therein. In addition, it is still further allowed to contain a small amount of a solvent such as acetone, methylethyl ketone and methyl chloride which are scarcely reacted with the foregoing cationic polymerization initiators, for the purpose of improving the fluidity in applying the coating agent.

The coating agent can be applied onto the surface of a protective layer in the following manner. The coating agent or that having a viscosity suitably adjusted, if required, by adding a solvent or the like is applied to the surface of the protective layer in an ordinary method such as a double-roll coating method, a slit coating method, an air-knife coating method, a wire-bar coating method, a slide-hopper coating method and a spray coating method. By suitably taking one of the above-given coating methods, a subject layer is applied with the coating agent onto the protective layer surface so as to have a thickness within the range of, usually, 0.1 to 30 μm and, desirably, 1 to 15 μm. After completing the coating, UV rays are irradiated to the layer applied with the coating agent so as to progress the polymerization or hardening reaction of the UV-hardenable prepolymer of the coating agent.

The term, 'UV rays', stated herein means the rays in a UV region and UV rays include the rays of light containing the light in a UV region. Therefore, the irradiation of UV rays include, for example; the irradiation of sunlight; that of a low-voltage mercury lamp; that of a high-voltage mercury lamp; that of a ultra-high voltage mercury lamp; that of a carbon-arc and so forth; that of a metal halide lamp and that of a xenon lamp. The atmospheric conditions for irradiating UV rays may include, for example, the atmospheric conditions of the air or an inert gas such as argon gas.

The time for irradiating UV rays may be varied according to the kinds of irradiating light sources in UV region. However, it is within the range of, usually, 0.5 seconds to 5 minutes and, desirably, 3 seconds to 2 minutes. When an irradiating time is relatively short, a large-sized light source having a substantially high irradiation intensity may be required. When the irradiating time is relatively long, a light source having a substantially low irradiation intensity may also be used. However, in the case of using a low irradiation intensity light source, it is not advantageous from the viewpoint of preparation processes, because the hardening reaction time is prolonged. In the invention, on the other hand, a hardened coat having a practically useful strength can be formed by irradiating for 3 seconds to 2 minutes with a UV ray-emitting lamp of not higher than 500W.

When hardening a coat, the hardening time can be shortened by heating a coating agent-applied layer when, before or after irradiating UV rays. When this is the case, the heating temperature is desirably within the range of 30° to 80° C. Before irradiating UV rays, the heating time may be longer or shorter when heating at the above-given temperature range. However, after irradiating UV rays, the heating time is desirably within the range of 1 to 120 minutes.

EXAMPLE

Now, the invention will be concretely detailed with reference to the following examples. Wherein, the expression, 'part or parts' means 'a part or parts by weight'.

EXAMPLE 1

Preparation of an Ink Sheet

A 6 μm-thick polyethylene terephthalate film [Lumirror F53N manufactured by Toray Corp.] was corona-discharged on the surface thereof as a support.

The ink layer-forming coating-solution having the following composition was coated on the surface thereof and dried up in a wire-bar coating method and, at the same time, a nitrocellulose solution containing s silicone resin [DAI-ALLOMER SP-712 manufactured by Dai-Nichi Seika Co., Ltd.] in a proportion of 50 wt % was coated on the rear surface of the support onto which no corona-discharge was applied and dried up in a wire-bar coating method so as to have a thickness to be 0.3 μm after dried. After that a rear surface coating treatment was then carried out, so that an ink sheet could be obtained.

| Ink layer-forming coating-solution | |
|---|---|
| Thermodiffusible dye [Kayaset Blue 714, manufactured by Nipon Kayaku Co., Ltd.] | 3.0 parts |
| Polyvinyl butyral [S-LEC BX-1, manufactured by Sekisui Chemical Co., Ltd.] | 3.0 parts |
| Methylethyl ketone | 84 parts |
| Cyclohexanone | 10 parts |

Preparation of Image-Receiving Sheet

The image-receiving layer-forming coating-solution having the following composition was dispersed on the corona-discharged surface of a 150 μm-thick synthetic paper [Yupo EFG-150 manufactured by Ohji Yuka-Goseishi Co., Ltd.] for serving as a base material by making use of a ultrasonic dispersing machine. The resulting dispersion was coated in order on the synthetic paper and dried in a coating method so as to form a 20 μm-thick image-receiving layer, and thereby an image-receiving sheet could be obtained.

| Image-receiving layer-forming coating-solution | |
|---|---|
| Styrene type resin [LITAC-A 200PC manufactured by Mitsui-Toatsu Chemical Co., Ltd.] | 7.5 parts |
| Magnesium oxide [High-purity, ultra-fine powder, Magnesia 100A having an average particle size of 15 nm] | 2.0 parts |
| Polyester-denatured silicone resin [X-24-8300, manufactured by Shinetsu Chemical Ind. Co., Ltd.] | 0.5 parts |
| Methylethyl ketone | 30 parts |
| Dioxane | 50 parts |
| Cyclohexanone | 10 parts |

Image Formation

The above-mentioned ink sheet and the image-receiving sheet were each superposed together so as to bring the former ink layer surface of the former and image-receiving layer of the latter into contact with each other and an image was formed by bringing a thermal head into contact with the ink sheet from the support side. Next, the ink sheet and the sheet were peeled off from each other, so that an image was transferred onto the image-receiving sheet.

| | |
|---|---|
| Linear densities of horizontal and vertical scanning: | 8 dots/mm |
| Record electricity: | 0.6 W/dot |
| Time for heating a thermal head: Adjusted stepwise between 20 msec. (applied energy: about $11.2 \times 10^{-3}$J) and 2 msec. (applied energy: about $1.12 \times 10^{-3}$J) | |

After completing the image-recording, the transfer density on the image-receiving layer surface, light-fastness of the image, fixability and bleeding preventability were each evaluated according to the following criteria. The results thereof are shown in Table-1.

Transfer Density

The OD values of the reflection densities were evaluated through an optical densitometer.

◎. . . OD value>2.5;
○. . . 2.5≧OD value>2.0;
Δ. . . 2.0>OD value>1.7; and
×. . . 1.7≧OD value Light-Fastness (Light-Fast Image Preservability)

An image-recorded image-receiving sheet was exposed for 72 hours to a xenon-weather meter and the image was then observed with the eye and, at the same time, the image was measured through a spectrophotometer and an optical densitometer. The results thereof were evaluated.

◎. . . Neither discoloration nor color-fading of the dyes were observed;
○. . . Slight discoloration and/or color-fading of the dyes were observed;
Δ. . . Discoloration and/or color-fading of the dyes were observed; and
×. . . Serious discoloration and/or color-fading of the dyes were observed.

Fixability of Dyes

An image-recorded image-receiving sheet and an image-receiving sheet not recording any image of the invention thereon were place face to face and while applying a load of 40 g/cm$^2$ thereto, they were allowed to stand at 60° C. for 48 hours. After that, the transfer densities of the dyes transferred to the non-image-recorded image-receiving sheet were evaluated.

◎. . . No transfer of any dyes was observed;
○. . . Density of the transferred dye was observed to be less than 0.10;
Δ. . . Density of the transferred dye was observed to be between not less than 0.10 and less than 0.15; and
×. . . Density of the transferred dye was observed to be not less than 0.15.

Bleeding Preventability of Dyes

The image-recorded image-receiving sheet was allowed to stand at 60° C. for one week and the dye bleeding degrees were then evaluated with the eye.

○. . . Any bleeding was observed at all;
Δ. . . Slight bleedings were observed; and
×. . . Bleedings were observed.

Preventability of Coloration on the White Background

An image-recorded image-receiving sheet was allowed to stand for 10 days (for the light-fastness test) or at 77° C. for 10 days (for the heat-resistance test) and the resulting blue density in the white background was evaluated.

◎. . . Less than 0.070 in the light-fastness and heat-resistance tests;
○. . . Not less than 0.070 to less than 0.120 in the light-fastness test or in the heat-resistance test;
Δ. . . Not less than 0.120 to less than 0.170 in the light-fastness test or in the heat-resistance test; and
×. . . Not less than 0.170 in the light-fastness test or in the heat-resistance test.

EXAMPLE 2

An image-receiving sheet was prepared in the same manner as in Example 1, except that, on a 125 μm-thick white polyethylene terephthalate film [W400 manufactured by Diafoil Co., Ltd.] for serving as a support, an image-receiving layer-forming coating-solution having the following composition was coated thereon and dried up in order with a super-sonic dispersing machine in a coating process, so that an image-receiving sheet could be formed. The resulting image was evaluated. The results thereof are shown in Table-1.

| Image receiving layer-forming coating solution | |
|---|---|
| Vinyl chloride type resin [that was a vinyl chloride-p-t-butyl benzoate copolymer having a Tg of 79° C., a polymerization degree of 670 and a vinyl chloride content of 86.9%] | 6.0 parts |
| Epoxy resin [Epotohto YD-014 manufactured by Tohto Chemical Co., Ltd.] | 2.5 parts |
| Tin oxide [Conductive powder T-1 having an average particle size of 20 nm, manufactured by Mitsubishi Materials Co., Ltd.] | 1.0 parts |
| Polyester-denatured silicone resin [X-24-8300 manufactured by Shinetsu Chemical Ind. Co., Ltd.] | 0.5 parts |
| Methylethyl ketone | 20 parts |
| Dioxane | 60 parts |
| Cyclohexanone | 10 parts |

EXAMPLE 3

Polyethylene containing titanium oxide having an average particle size of 0.3 μm in a proportion of 12 wt % was fusedly kneaded well and the resulting kneaded polyethylene was then fusedly laminated on the surface of a 120 g/m$^2$ of a paper for serving as a base material. After corona-discharging the one side thereof, the corona-discharged surface was coated with an aqueous gelatin solution containing 5 wt % of titanium oxide having an average particle size of 0.4 μm and a hardener. The coated surface was the set and dried up, so that a 0.2 μm-thick sublayer could be prepared.

Next, an image-receiving sheet was prepared in the same manner as in Example 1, except that a 20 μm-thick image-receiving layer was prepared by dispersing an image-receiving layer-forming coating solution having the following composition through a ultra-sonic dispersing machine and applying the resulting coating solution in order onto the sublayer, and after completing the coating, it was dried up. An image was formed by making use of the ink sheet described in Example 1 and the resulting image was evaluated. The results thereof are shown in Table-1.

| Image-receiving layer-forming coating-solution | |
|---|---|
| Polystyrene resin [Toporex 550-51 manufactured by Mitsui-Toatsu Chemical Co., Ltd.] | 7.5 parts |
| Magnesium oxide [High-purity, ultra-fine powdered magnesia 100 A having an average particle size of 15 nm] | 2.0 parts |
| Polyester-denatured silicone resin [X-24-8300 manufactured by Shinetsu Chemical Ind. Co., Ltd.] | 0.5 parts |
| Methylethyl ketone | 60 parts |
| Dioxane | 20 parts |
| Cyclohexanone | 10 parts |

EXAMPLE 4

An image-receiving sheet was prepared in the same manner as in Example 1, except that an image-receiving layer-forming coating-solution having the following composition was dispersedly prepared by a ultra-sonic dispersing machine and the resulting coating solution was then coated on a 188 μm-thick transparent polyethylene terephthalate film [S 100 manufactured by Diafoil Co., Ltd.] as the base material and then dried in order in a coating process, so that a 20 μm-thick image-receiving layer could be provided. Then, an image was formed by making use of the same ink sheet as in Example 1 and the resulting image was evaluated. The results thereof are shown in Table-1.

| Image-receiving layer-forming coating-solution | |
|---|---|
| Vinyl chloride type resin [Laroflex MP manufactured by BASF] | 6.0 parts |
| Vinyl chloride type resin [Shinetsu PVC TK-300 manufactured by Shinetsu Chemical Ind. Co., Ltd.] | 2.5 parts |
| Tin oxide {Conductive powder T-1 having an average particle size of 20 nm, manufactured by Mitsubishi Material Co., Ltd.] | 1.0 part |
| Polyester-denatured silicone resin [X-24-8300 manufactured by Shinetsu Chemical Ind. Co., Ltd.] | 0.5 parts |
| Methylethyl ketone | 60 parts |
| Dioxane | 20 parts |
| Cyclohexanone | 10 parts |

EXAMPLE 5

An image-receiving sheet was prepared in the same manner as in Example 1, except that an image-receiving layer-forming coating-solution having the following composition was dispersedly prepared by a ultra-sonic dispersing machine and the resulting coating solution was coated on the same base material as used in Example 1 and then dried in order in a coating process, so that an image was formed by making use of the same ink sheet as used in Example 2. The resulting image was evaluated. The results thereof are shown in Table-1.

| Image-receiving layer-forming coating-solution | |
|---|---|
| Styrene type resin [Vitax V6700 manufactured by Hitachi Chemical Co., Ltd.] | 4.0 parts |
| Polyether polyol [Desmophen 550U manufactured by Sumitomo-Bayer Urethane Co., Ltd.] | 2.5 parts |
| Tin oxide [Conductive powder T-1 having an average particle size of 20 nm, manufactured by Mitsubishi Material Co., Ltd.] | 2.0 parts |
| Light stabilizer [Irgafos 168 manufactured by Ciba-Geigy Ag] | 1.0 part |
| Polyester-denatured silicone resin [X-24-8300 manufactured by Shinetsu Chemical Ind. Co., Ltd.] | 0.5 parts |
| Methylethyl ketone | 60 parts |
| Dioxane | 20 parts |
| Cyclohexanone | 10 parts |

EXAMPLE 6

An image-receiving sheet was prepared in the same manner as in Example 1, except that an image-receiving layer-forming coating-solution having the following composition was dispersedly prepared by a ultra-sonic dispersing machine and the resulting coating solution was coated on the same base material as used in Example 2 and then dried in order in a coating process, so that a 20 μm-thick image-receiving layer could be provided. An image was formed by making use of the same ink sheet as used in Example 1 and the resulting image was evaluated. The results thereof are shown in Table-1.

| Image-receiving layer-forming coating-solution | |
|---|---|
| Vinyl chloride type resin [Shinetsu PVC TK-300 manufactured by Shinetsu Chemical Ind. Co., Ltd.] | 3.3 parts |
| Acryl polyol [Desmophen A365 manufactured by Sumitomo-Bayer Urethane Co., Ltd.] | 1.0 part |
| Magnesium oxide [High-purity, superfine powder Magnesia 100A having an average particle size of 15 nm, manufactured by Ube Kosan Co., Ltd.] | 5.0 parts |
| Light stabilizer (Compound A) | 0.2 parts |
| Polyester-denatured silicone resin [X-24-8300 manufactured by Shinetsu Chemical Ind. Co., Ltd.] | 0.5 parts |
| Methylethyl ketone | 60 parts |
| Dioxane | 20 parts |
| Cyclohexanone | 10 parts |
| Thermodiffusible dye | |

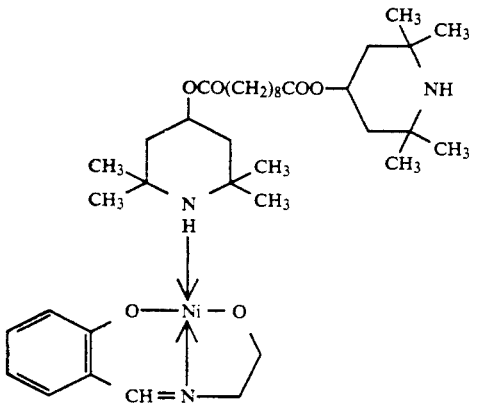

EXAMPLES 7~12

An image-receiving sheet was prepared in the same manner as in Example 1, except that magnesium oxide or tin oxide used in Examples 1 through 6 was replaced by titanium oxide having an average particle size of 20 nm [Idemitsu Titania IT-UD manufactured by Idemitsu Kosan Co., Ltd.] and an image-receiving layer-forming coating-solution was dispersedly prepared similarly by a ultrasonic dispersing machine. The resulting coating-solution was coated on the respective base materials on order in a coating process and then dried, so that a 20 μm-thick image-receiving layer could be provided. An image was formed by making use of the same ink sheet as used in Example 1 and the resulting image was evaluated. The results thereof are shown in Table-1.

EXAMPLES 13~18

An image-receiving sheet was prepared in the same manner as in Example 1, except that magnesium oxide or tin oxide used in Examples 1 through 6 was replaced by zinc oxide having an average particle size of 10 nm [Super-fine zinc oxide ZnO-100 manufactured by Sumitomo Cement Co., Ltd.] and an image-receiving layer-forming coating-solution was dispersedly prepared similarly by a ultrasonic dispersing machine. The resulting coating-solution was coated on the respective base materials on order in a coating process and then dried, so that a 20 μm-thick image-receiving layer could be provided. An image was formed by making use of the same ink sheet as used in Example 1 and the resulting image was evaluated. The results thereof are shown in Table-1.

EXAMPLE 19

An image-receiving sheet was prepared in the same manner as in Example 1, except that an image-receiving layer-forming coating-solution having the following composition was dispersedly prepared by a ultrasonic dispersing machine and the resulting coating solution was coated on the same base material as used in Example 3 and dried in a coating process, so that a 20 μm-thick image-receiving layer could be provided. An image was formed by making use of the same ink sheet as used in Example 1 and the resulting image was evaluated. The results thereof are shown in Table-1.

| Image-receiving layer-forming coating-solution | |
|---|---|
| Vinyl chloride type resin [Laroflex MP60 manufactured by BASF] | 4.5 parts |
| Titanium oxide [Idemitsu-Titania IT-UD having an average particle size of 20 nm, manufactured by Idemitsu Kosan Co., Ltd.] | 1.0 part |
| Zinc oxide [ZnO-200 having an average particle size of 15 nm, manufactured by Sumitomo Cement Co., Ltd.] | 3.0 parts |
| Light stabilizer.Antioxidant [Irganox B225 manufactured by Ciba-Geigy AG] | 1.0 part |
| Polyester-denatured silicone resin [X-24-8300 manufactured by Shinetsu Chemical Ind. Co., Ltd.] | 0.5 parts |
| Methylethyl ketone | 60 parts |
| Dioxane | 20 parts |
| Cyclohexanone | 10 parts |

COMPARATIVE EXAMPLE 1

An image-receiving layer was prepared in the same manner as in Example 1, except that magnesium oxide was not added in Example 1. An image was formed by making use of the same ink sheet as used in Example 1 and the resulting image was evaluated. The results thereof are shown in Table-1.

COMPARATIVE EXAMPLE 2

An image-receiving layer was prepared in the same manner as in Example 5, except that the tin oxide used in Example 5 was replaced by an organic type UV absorbent [a benzotriazole type UV absorbent, Tinuvin 326 manufactured by Ciba-Geigy AG]. An image was formed by making use of the same ink sheet as used in Example 1 and the resulting image was evaluated. The results thereof are shown in Table-1.

COMPARATIVE EXAMPLE 3

An image-receiving layer was prepared in the same manner as in Example 6, except that magnesium oxide used in Example 6 was replaced by an organic type UV absorbent [a cyanoacrylate type UV absorbent, Uvinul N-35 manufactured by BASF]. An image was formed by making use of the same ink sheet as used in Example 1 and the resulting image was evaluated. The results thereof are shown in Table-1.

EXAMPLE 20

Preparation of the Ink Sheet

An ink sheet was prepared in the same manner as in Example 1, except that the ink layer-forming coating-solution as used in Example 1 was replaced by those having the following composition.

| Ink layer-forming coating-solution | |
|---|---|
| Thermodiffusible dye | 2.5 parts |

-continued

| Ink layer-forming coating-solution | |
|---|---|
| Polyvinyl butyral [S-LEC BX-1 manufactured by Sekisui Chemical Co., Ltd.] | 2.5 parts |
| Methylethyl ketone | 40 parts |
| Dioxane | 45 parts |
| Cyclohexanone | 10 parts |
| Compound A | |

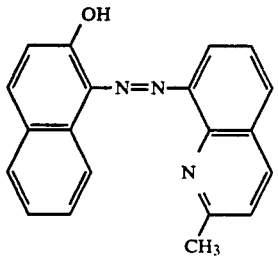

Preparation of the Image-Receiving Sheet

An image-receiving sheet was prepared in the same manner as in Example 1, except that an image-receiving layer-forming coating-solution having the following composition was dispersedly prepared and the resulting coating-solution was coated in order by a ultrasonic dispersing machine on a 280 μm-thick white polyvinyl chloride film [Sumilite VSS-3101 manufactured by Sumitomo Bakelite Co., Ltd.] as the base material and then dried in a coating process, so that a 10 μm-thick image-receiving layer could be provided. An image was formed by making use of the same ink sheet as used in Example 2 and the resulting image was evaluated. The results thereof are shown in Table-2.

| Image-receiving layer-forming coating-solution | |
|---|---|
| Styrene type resin [LITAC-A 120PC manufactured by Mitsui-Toatsu Chemical Co., Ltd.] | 4.0 parts |
| Polyether polyol [Desmophen 1600U manufactured by Sumitomo-Bayer Urethane Co., Ltd.] | 2.0 parts |
| Tin oxide [Conductive powder T-1 having an average particle size of 20 nm, manufactured by Mitsubishi Material Co., Ltd.] | 0.9 parts |
| Metal ion-containing compound [MS-1] | 3.0 parts |
| Polyester-denatured silicone resin [X-24-8300 manufactured by Shinetsu Chemical Ind. Co., Ltd.] | 0.1 parts |
| Methylethyl ketone | 60 parts |
| Dioxane | 20 parts |
| Cyclohexanone | 10 parts |

MS-1: $[Ni^{2+}(NH_2COCH_2NH_2)_3].2[(C_6H_5)_4B]^-$

EXAMPLE 21

An image-receiving sheet was prepared in the same manner as in Example 1, except that an image-receiving layer-forming coating-solution having the following composition was dispersedly prepared by a ultrasonic dispersing machine and the resulting coating-solution was coated, in a coating process, on a 100 μm-thick transparent polyethylene terephthalate film [S-100 manufactured by Diafoil Co., Ltd.] as the base material and then dried in order, so that a 10 μm-thick image-receiving layer could be provided. An image was formed by making use of the same ink sheet as used in Example 20 and the resulting image was evaluated. The results thereof are shown in Table-2.

| Image-receiving layer-forming coating-solution | |
|---|---|
| Polystyrene type resin [GP Styron 666 manufactured by Asahi-Kasei Inc. Co., Ltd.] | 6.5 parts |
| Magnesium oxide [High-purity, superfine powder, Magnesia 100A having an average particle size of 15 nm, manufactured by Ube Kosan Co., Ltd.] | 0.5 parts |
| Metal ion-containing compound [MS-2] | 2.0 parts |
| Polyester-denatured silicone resin [X-24-8300 manufactured by Shinetsu Chemical Ind. Co., Ltd.] | 0.5 parts |
| Phthalic acid alkyl ester [DOP manufactured by Dai-Hachi Chemical Co., Ltd.] | 0.5 parts |
| Methylethyl ketone | 50 parts |
| Dioxane | 30 parts |
| Cyclohexanone | 10 parts |

MS-2: $[Ni^{2+}(C_3H_7NHCOCH_2NH_2)_3].2[(C_6H_5)_4B]^-$

EXAMPLE 22

A polyolefin-coated base material was prepared in the following manner. Both sides of a 350 μm-thick white polyethylene terephthalate film containing a white pigment [Melinex 226 manufactured by ICI] were corona-discharged, and a) polypropylene containing 10% titanium oxide (having an average particle size of 0.3 μm) and having a concentration of 0.90 and an MI of 7.0 was fusedly kneaded well and the kneaded polypropylene was fusedly extruded on one side of the film by applying a load of 40 g/m$^2$ and b) polypropylene containing 15% titanium oxide (having an average particle size of 0.3 μm) and having a concentration of 0.90 and an MI of 7.0 was fusedly kneaded well and the kneaded polypropylene was fusedly extruded on the rear side of the film by applying a load of 40 g/m$^2$. After corona-discharging the side a), a sublayer-forming coating-solution having the following composition was prepared and the resulting coating-solution was coated on side a) in order in a coating process and dried. After providing the 2 μm-thick sublayer, the sublayer was hardened at 100° C. for one hour.

Next, an image-receiving layer was prepared in the same manner as in Example 1, except that an image-receiving layer-forming coating-solution having the following composition was dispersedly prepared by a sand-grinder and the resulting coating-solution was coated on the sublayer in a coating process and dried so as to provide a 10 μm-thick image-receiving layer. An image was formed by making use of the same ink sheet as used in Example 20 and the resulting image was evaluated. The results thereof are shown in Table-2.

| Sublayer-forming coating-solution | |
|---|---|
| Polyurethane resin [Takelac A-367H manufactured by Takeda Phermaceutical Ind. Co., Ltd.] | 7.5 parts |
| Hardener [Takenate A-7 manufactured by Takeda Phermaceutical Ind. Co., Ltd.] | 2.5 parts |
| Methylethyl ketone | 80 parts |
| Cyclohexanone | 10 parts |
| **Image-receiving layer-forming coating-solution** | |
| Vinyl chloride type resin [Laroflex MP25 manufactured by BASF] | 3.5 parts |
| Polyether polyol [Desmophen 1600U manufactured by Sumitomo-Bayer Urethane Co., Ltd.] | 2.0 parts |
| Tin oxide [Conductive powder T-1 having an average particle size of 20 nm, manufactured by Mitsubishi Material Co., Ltd.] | 0.9 parts |
| Metal ion-containing compound [MS-1] | 2.5 parts |
| Light stabilizer [Irgafos 168 manufactured by Ciba-Geigy AG] | 1.0 part |
| Polyester-denatured silicone resin [X-24-8300 manufactured by Shinetsu Chemical Ind. Co., Ltd.] | 0.1 parts |
| Methylethyl ketone | 60 parts |

-continued

| | |
|---|---|
| Dioxane | 20 parts |
| Cyclohexanone | 10 parts |

EXAMPLE 23

An image-receiving sheet was prepared in the same manner as in Example 1, except that an image-receiving layer-forming coating-solution having the following composition was dispersedly prepared by a ultrasonic dispersing machine and the resulting coating solution was coated on one side of a 250 μm-thick polyethylene terephthalate film containing a white pigment [Crisper G1212 manufactured by Toyobo Co., Ltd.] and then dried so as to prepare a 10 μm-thick image-receiving layer. An image was formed by making use of the same ink sheet as used in Example 20 and the resulting image was evaluated. The results thereof are shown in Table-2.

| Image-receiving layer-forming coating-solution | |
|---|---|
| Styrene type resin [JSR AES117 manufactured by Japan Synthetic Rubber Co., Ltd.] | 6.3 parts |
| Magnesium oxide [High-purity, superfine powder, Magnesia 100A having an average particle size of 15 nm, manufactured by Ube Kosan Co., Ltd.] | 0.5 parts |
| Metal ion-containing compound [MS-2] | 2.0 parts |
| Light stabilizer (Compound A) | 0.2 parts |
| Polyester-denatured silicone resin [X-24-8300 manufactured by Shinetsu Chemical Ind. Co., Ltd.] | 0.5 parts |
| Trimellitic acid alkyl ester [ADK CIZER C-79 manufactured by Asahi Denka Ind. Co., Ltd.] | 0.5 parts |
| Methylethyl ketone | 50 parts |
| Dioxane | 30 parts |
| Cyclohexanone | 10 parts |

EXAMPLES 24~27

An image-receiving sheet was prepared in the same manner as in Example 1, except that magnesium oxide or tin oxide used each in Examples 20 to 23 was replaced by titanium oxide having an average particle size of 20 nm [Idemitsu-Titania IT-UD manufactured by Idemitsu Kosan Co., Ltd.] and an image-receiving layer-forming coating-solution was dispersedly prepared by a ultrasonic dispersing machine similarly. The resulting coating-solution was coated in order on the respective base materials in a coating process and then dried so as to provide a 10 μm-thick image-receiving layer. An image was formed by making use of the same ink sheet as used in Example 20 and the resulting image was evaluated. The results thereof are shown in Table-2.

EXAMPLES 28~31

An image-receiving sheet was prepared in the same manner as in Example 1, except that magnesium oxide or tin oxide used each in Examples 20 to 23 was replaced by zinc oxide having an average particle size of 15 nm [Superfine zinc oxide ZnO-200 manufactured by Sumitomo Cement Co., Ltd.] and an image-receiving layer-forming coating-solution was dispersedly prepared by a ultrasonic dispersing machine similarly. The resulting coating-solution was coated in order on the respective base materials in a coating process and then dried so as to provide a 10 μm-thick image-receiving layer. An image was formed by making use of the same ink sheet as used in Example 20 and the resulting image was evaluated. The results thereof are shown in Table-2.

EXAMPLE 32

An image-receiving sheet was prepared in the same manner as in Example 1, except that an image-receiving layer-forming coating-solution having the following composition was dispersedly prepared by a sand-grinder and the resulting coating-solution was coated on the same base material as used in Example 2 in a coating process and then dried so as to prepare a 10 μm-thick image-receiving layer. An image was formed by making use of the same ink sheet as used in Example 20 and the resulting image was evaluated. The results thereof are shown in Table-2.

| Image-receiving layer-forming coating-solution | |
|---|---|
| Polyvinyl acetoacetal resin [S-LEC KW-1 manufactured by Sekisui Chemical Ind. Co., Ltd.] | 11.0 parts |
| Titanium oxide [Idemitsu-Titania IT-S having an average particle size of 17 nm manufactured by Idemitsu Kosan Co., Ltd. | 2.0 parts |
| Metal ion-containing compound [MS-1] | 6.0 parts |
| Polyester-denatured silicone resin [X-24-8300 manufactured by Shinetsu Chemical Ind. Co., Ltd.] | 1.0 part |
| Water | 80.0 parts |

EXAMPLE 33

An image-receiving sheet was prepared in the same manner as in Example 1, except that an image-receiving layer-forming coating-solution having the following composition was dispersedly prepared by a ultrasonic dispersing machine and the resulting coating solution was coated in order in a coating process on a sublayer applied to the same base material as used in Example 22 and then dried so as to provide a 10 μm-thick image-receiving layer. An image was formed by making use of the same ink sheet as used in Example 20 and the resulting image was evaluated. The results thereof are shown in Table-2.

| Image-receiving layer-forming coating-solution | |
|---|---|
| Vinyl chloride type resin [Laroflex MP60 manufactured by BASF] | 3.5 parts |
| Vinyl chloride type resin [Shinetsu PVC TK300 manufactured by Shinetsu Chemical Ind. Co., Ltd.] | 1.5 parts |
| Titanium oxide [Idemitsu-Titania IT-UD having an average particle size of 20 nm, manufactured by Idemitsu Kosan Co., Ltd.] | 0.5 parts |
| Zinc oxide [ZnO-200 having an average particle size of 15 nm, manufactured by Sumitomo Cement Co., Ltd.] | 1.0 part |
| Metal ion-containing compound [MS-1] | 2.0 parts |
| Light stabilizer.Antioxidant [Irganox B225 manufactured by Ciba-Geigy AG.] | 1.0 part |
| Polyester-denatured silicone resin [X-24-8300 manufactured by Shinetsu Chemical Ind. Co., Ltd.] | 0.5 parts |
| Methylethyl ketone | 60 parts |
| Dioxane | 20 parts |
| Cyclohexanone | 10 parts |

COMPARATIVE EXAMPLE 4

An image-receiving layer was formed in the same manner as in Example 20, except that no tin oxide was added in Example 20. An image was formed by making use of the same ink sheet as used in Example 20 and the resulting image was evaluated. The results thereof are shown in Table-2.

COMPARATIVE EXAMPLE 5

An image-receiving layer was formed in the same manner as in Example 5, except that tin oxide used in Example 5 was replaced by an organic type UV absorbent [a benzotriazole type UV absorbent, Tinuvin 326 manufactured by Ciba-Geigy AG.] An image was formed by making use of the same ink sheet as used in Example 20 and the resulting image was evaluated. The results thereof are shown in Table-2.

COMPARATIVE EXAMPLE 6

An image-receiving layer was formed in the same manner as in Example 20, except that magnesium oxide used in Example 23 was replaced by an organic type UV absorbent [a cyanoacrylate type UV absorbent, Uvinul N-35 manufactured by BASF]. An image was formed by making use of the same ink sheet as used in Example 20 and the resulting image was evaluated. The results thereof are shown in Table-2.

EXAMPLE 34

Preparation of a Protective Sheet

An extruded matter was prepared in the following manner. Polyethylene terephthalate [Belpet EFG-7 manufactured by Kanegafuchi Chemical Ind. Co., Ltd.] containing 3 wt % titanium oxide [Idemitsu-Titania IT-OD having an average particle size of 17 nm, manufactured by Idemitsu Kosan Co., Ltd.] was fusedly kneaded well and, the resulted knead matter was extruded from a film-forming die onto a water-cooled rapid-cooling rotary drum. The resulting extruded matter was heated at 80° C. and stretched in the ratio of 3.1:1 in the longitudinal direction. Next, the stretched extruded matter was heated at 85° C. and stretched in the stretching ratio of 3.4:1 in the lateral direction. After that, a subject 50 μm-thick polyethylene terephthalate film containing transparent titanium oxide could be obtained by heat-setting it at about 220° C. while dimensionally restraining it in a tenter.

Next, a protective sheet was prepared by coating an adhesive layer-forming coating-solution having the following composition on the above-mentioned film in a wire-bar coating process and then dried so as to have a dried thickness of 2.0 μm.

| Adhesive layer-forming coating-solution | |
|---|---|
| A vinyl chloride-vinyl acetate copolymer [VYHH manufactured by Union Carbide Co.] | 3.0 parts |
| Methylethyl ketone | 6.0 parts |
| Cyclohexanone | 1.0 part |

(Preparation of an image-receiving sheet attached with the protective sheet)

An image-receiving sheet attached with a protective sheet was prepared in the following manner. The same protective sheet as prepared in the above-described manner and the surface of the image-receiving layer of the image-receiving sheet image-formed thereon in Comparative Example 1 are superposed together and the superposed sheets were subjected to a heat-pressure treatments at a pressure of 1.5 Kg/cm$^2$ and a temperature of 170° C. and for one second, so that the image-receiving sheet could be prepared. The image was evaluated according to the following criteria and the results thereof are shown in Table-3.

Light-Fastness (Light-Fast Image Preservability)

The image-recorded image-receiving sheet attached with the protective sheet was exposed to a xenon weather meter for 10 days and then the resulting image was observed with the eye and, at the same time, the image was also measured through a spectrophotometer and an optical densitometer. The results of the measurements were then evaluated.

◎. . . Neither discoloration nor color-fading of the dyes was observed at all;

○. . . Slight discoloration and color-fading of the dyes were observed;

Δ. . . The discoloration and color-fading of the dyes were observed; and

×. . . Serious discoloration and color-fading of the dyes were observed.

Heat-Resistance (Heat-Resistive Image Preservability)

The image-recorded image-receiving sheet attached with the protective sheet was preserved at 77° C. for 10 days and the resulting image was then observed with the eye and, at the same time, the image was also measured through a spectrophotometer and an optical densitometer. The results of the measurements were evaluated.

◎. . . Neither discoloration nor color-fading of the dyes was observed at all

○. . . Slight discoloration and color-fading of the dyes were observed;

Δ. . . The discoloration and color-fading of the dyes were observed; and

×. . . Serious discoloration and color-fading of the dyes were observed.

Dye-Bleeding Prevention Property

The image-recorded image-receiving sheet attached with the protective sheet was allowed to stand at 60° C. for 2 weeks and the resulting dye-bleeding degrees were evaluated with the eye.

○. . . No bleeding was observed;

Δ. . . Slight bleeding was observed; and

×. . . Bleeding was observed.

Coloring Prevention on the White Background

The non-image-recorded image-receiving sheet attached with the protective sheet was exposed to a xenon weather meter for one month (for the light-fast test) or was allowed to stand at 77° C. for one month (for the heat-resistance test). The resulting blue-density in the white background area was measured and the results of the measurements were evaluated.

◎. . . Less than 0.120 obtained in both of the light-fast and heat-resistance tests;

○. . . Not less than 0.070 to less than 0.120 obtained in the light-fast or heat-resistance test;

Δ. . . Not less than 0.120 to less than 0.170 obtained in the light-fast or heat-resistance test; and ×. . . Not less than 0.170 obtained in the light-fast or heat-resistance test.

EXAMPLE 35

An image-receiving sheet attached with a protective sheet was prepared in the same manner as in Example 34 by making use of the same image-receiving sheet as prepared in Comparative Example 1 on which an image was formed, except that an adhesive layer-forming coating-solution having the following composition was dispersedly prepared by a ultrasonic dispersing machine and the resulting coating-solution was coated in a wire-bar coating process on a 25 μm-thick polyethylene terephthalate film [S100 manufactured by Diafoil Co., Ltd.] for serving as the support so as to have a dried thickness of 2.0 μm and then dried, so that a protective sheet could be obtained. The resulting image was then evaluated and the results of the evaluation are shown in Table-3.

| Adhesive layer-forming coating-solution | |
|---|---|
| Acryl type resin [Dianal BR64 manufactured by Mitsubishi Rayon Co., Ltd.] | 2.8 parts |
| Titanium oxide [Idemitsu-Titania IT-OA having an average particle size of 17 nm, manufactured by Idemitsu Kosan Co., Ltd.] | 0.2 parts |
| Methylethyl ketone | 6.0 parts |
| Cyclohexanone | 1.0 part |

EXAMPLE 36

An image-receiving sheet attached with a protective sheet was prepared in the same manner as in Example 34 by making use of the image-recorded image-receiving sheet prepared in Example 7, except that an adhesive layer-forming coating-solution having the following composition was dispersedly prepared by a ultrasonic dispersing machine and the resulting coating-solution was coated in a wire-bar coating process and then dried so as to have a dried thickness of 2.0 μm, so that a protective sheet could be obtained. The resulting image was then evaluated and the results thereof are shown in Table-3.

| Adhesive layer-forming coating-solution | |
|---|---|
| A vinyl chloride-vinyl acetate copolymer [VYHH manufactured by Union Carbide Co.] | 2.7 parts |
| Titanium oxide [Idemitsu-Titania IT-UD having an average particle size of 20 nm, manufactured by Idemitsu Kosan Co., Ltd.] | 0.3 parts |
| Methylethyl ketone | 6.0 parts |
| Cyclohexanone | 1.0 part |

EXAMPLE 37

An image-receiving sheet attached with a protective sheet was prepared in the same manner as in Example 34 by making use of the same image-formed image-receiving sheet as prepared in Example 13, except that an adhesive layer-forming coating-solution having the following composition was dispersedly prepared by a ultrasonic dispersing machine and the resulting coating-solution was coated on the same support as used in Example 35 in a wire-bar coating process and then dried so as to have a dried thickness of 2.0 μm, so that a protective sheet could be obtained. The resulting image was evaluated and the results thereof are shown in Table-3.

| Adhesive layer-forming coating-solution | |
|---|---|
| Acryl type resin [Dianal BR64 manufactured by Mitsubishi Rayon Co., Ltd.] | 2.4 parts |
| Titanium oxide [Idemitsu-Titania IT-OA having an average particle size of 17 nm, manufactured by Idemitsu Kosan Co., Ltd.] | 0.3 parts |
| Light stabilizer [Irganox 168 manufactured by Ciba-Geigy AG.] | 0.3 parts |
| Methylethyl ketone | 6.0 parts |

-continued

| Adhesive layer-forming coating-solution | |
|---|---|
| Cyclohexanone | 1.0 part |

EXAMPLE 38

An image-receiving sheet attached with a protective sheet was prepared in the same manner as in Example 34 by making use of the same image-formed image-receiving sheet as prepared in Example 19, except that an adhesive layer-forming coating-solution having the following composition was dispersedly prepared by a ultrasonic dispersing machine and the resulting coating-solution was coated on the same support as prepared in Example 34 in a wire-bar coating process and then dried so as to have a dried thickness of 2.0 μm, so that a protective sheet could be obtained. The resulting image was evaluated and the results thereof are shown in Table-3.

| Adhesive layer-forming coating-solution | |
|---|---|
| A vinyl chloride-vinyl acetate copolymer [VYHH manufactured by Union Carbide Co.] | 2.64 parts |
| Titanium oxide [Idemitsu-Titania IT-UD having an average particle size of 20 nm, manufactured by Idemitsu Kosan Co., Ltd.] | 0.3 parts |
| Light stabilizer (Compound A) | 0.06 parts |
| Methylethyl ketone | 6.0 parts |
| Cyclohexanone | 1.0 part |

EXAMPLE 39

An image-receiving sheet attached with a protective sheet was prepared in the same manner as in Example 34, except that the same image-formed image-receiving sheet as prepared in Example 20 and the same protective sheet as used in Example 34 were each used. The resulting image was evaluated and the results thereof are shown in Table-3.

EXAMPLE 40

An image-receiving sheet attached with a protective sheet was prepared in the same manner as in Example 34, except that the same image-formed image-receiving sheet as formed in Example 24 and the same protective sheet as used in Example 25 were each used. The resulting image was evaluated and the results thereof are shown in Table-3.

EXAMPLE 41

An image-receiving sheet attached with a protective sheet was prepared in the same manner as in Example 34, except that the same image-formed image-receiving sheet as formed in Example 28 and the same protective sheet as used in Example 36 were each used. The resulting image was evaluated and the results thereof are shown in Table-3.

EXAMPLE 42

An image-receiving sheet attached with a protective sheet was prepared in the same manner as in Example 34, except that the same image-formed image-receiving sheet as formed in Example 33 and the same protective sheet as used in Example 37 were each used. The resulting image was evaluated and the results thereof are shown in Table-3.

EXAMPLES 43~51

In each of these examples, an image-receiving sheet attached with a protective sheet was prepared in the same manner as in Examples 34~42, except that titanium oxide used for forming the protective sheet in Examples 34~42 was replaced by zinc oxide having a particle size of 15 nm [Superfinely particulate zinc oxide ZnO-200 manufactured by Sumitomo Cement Co., Ltd.]. The resulting image was evaluated and the results thereof are shown in Table-3.

EXAMPLE 52

An image-receiving sheet attached with a protective sheet was prepared in the same manner as in Example 34 by making use of the same image-receiving sheet as prepared in Example 20, except that an adhesive layer-forming coating-solution having the following composition was dispersedly prepared by a ultrasonic dispersing machine and the resulting coating-solution was coated on the same polyethylene terephthalate film containing titanium oxide as prepared in Example 34 in a wire-bar coating process and then dried so as to have a dried thickness of 2.0 μm, so that a protective sheet could be obtained. The resulting image was evaluated and the results thereof are shown in Table-3.

| Adhesive layer-forming coating-solution | |
|---|---|
| A vinyl chloride-vinyl acetate copolymer [VYHH manufactured by Union Carbide Co.] | 2.17 parts |
| Zinc oxide [Superfinely particulate ZnO-100 having an average particle size of 10 nm, manufactured by Sumitomo Cement Co., Ltd.] | 0.2 parts |
| Titanium oxide [Idemitsu-Titania IT-UD having an average particle size of 20 nm, manufactured by Idemitsu Kosan Co., Ltd.] | 0.03 parts |
| Metal ion-containing compound [MS-1] | 0.3 parts |
| Light stabilizer.antioxidant [Irganox B225 manufactured by Ciba-Geigy AG.] | 0.3 parts |
| Methylethyl ketone | 6.0 parts |
| Cyclohexanone | 1.0 part |

COMPARATIVE EXAMPLE 7

An image-receiving sheet attached with a protective sheet was prepared by making use of the same image-formed image-receiving sheet as prepared in Comparative Example 1 in the same manner as in Example 34, except that an adhesive layer-forming coating-solution having the following composition was prepared and the resulting coating solution was coated in a wire-bar coating process on the same support as used in Example 35 and dried so as to have a dried thickness of 2.0 μm, so that a protective sheet could be obtained. The resulting image was evaluated and the results thereof are shown in Table-3.

| Adhesive layer-forming coating-solution | |
|---|---|
| Acryl type resin [Dianal BR64 manufactured by Mitsubishi Rayon Co., Ltd.] | 3.0 parts |
| Methylethyl ketone | 6.0 parts |
| Cyclohexanone | 1.0 part |

COMPARATIVE EXAMPLE 8

An image-receiving sheet attached with a protective sheet was prepared by making use of the same image-formed image-receiving sheet as formed in Comparative Example 1 in the same manner as in Example 34, except that an adhesive layer-forming coating-solution having the following composition was prepared and the coating-solution was then coated in the same support as used in Example 35 in a wire-bar coating process and dried so as to have a dried thickness of 2.0 μm, so that a protective sheet could be obtained. The resulting image was evaluated and the results thereof are shown in Table-3.

| Adhesive layer-forming coating-solution | |
|---|---|
| A vinyl chloride-vinyl acetate copolymer [VYHH manufactured by Union Carbide Co.] | 2.5 parts |
| UV absorbent [Tinuvin 320 manufactured by Ciba-Geigy AG.] | 0.5 parts |
| Methylethyl ketone | 6.0 parts |
| Cyclohexanone | 1.0 part |

COMPARATIVE EXAMPLE 9

An image-receiving sheet attached with a protective sheet was prepared in the same manner as in Example 34 by making use of the same image-formed image-receiving sheet as used in Example 20, except that an adhesive layer-forming coating solution having the following composition was prepared in a wire-bar coating process and the resulting coating solution was coated and dried so as to have a dried thickness of 2.0 μm, so that a protective sheet could be obtained. The resulting image was evaluated and the results thereof are shown in Table-3.

| Adhesive layer-forming coating-solution | |
|---|---|
| A vinyl chloride-vinyl acetate copolymer [VYHH manufactured by Union Carbide Co.] | 2.44 parts |
| UV absorbent [Tinuvin 320 manufactured by Ciba-Geigy AG.] | 0.5 parts |
| Light stabilizer (Compound A) | 0.06 parts |
| Methylethyl ketone | 6.0 parts |
| Cyclohexanone | 1.0 part |

EXAMPLE 53

Preparation of the Protective Layer-Transfer Sheet

A protective layer-transfer sheet was prepared in the following manner. A protective layer-forming coating-solution having the following composition was dispersedly prepared by a ultrasonic dispersing machine and the resulting coating-solution was coated to have spaces in the plane direction in a wire-bar coating process on the corona-discharged surface of a 15 μm-thick polypropylene film [Torayphane BO Type 2400 #15 manufactured by Toray Corp.] for serving as the support and then dried so as to have a dried thickness of 5 μm and, at the same time, a backing layer was formed on the rear surface of the support, on which no corona-discharge was subjected, by dropping one or two drops of a nitrocellulose solution containing silicone resin [Dai-Allomer SP-2105 manufactured by Dai-Nichi Seika Co., Ltd.] through a pippet so that the back-surface coating could be treated by spreading the drops over the whole support surface.

Figure 7:
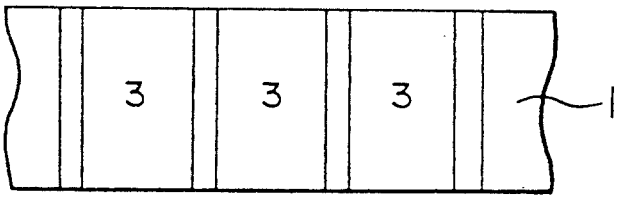
[FIG. 7] A top plan view of a protective layer-transfer sheet given in Example 53.
Figure 8:
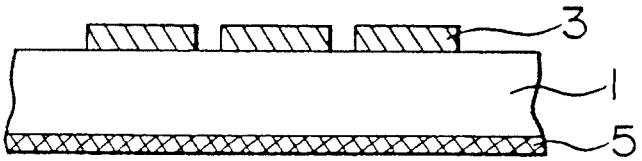
[FIG. 8] A cross-sectional view of a protective layer-transfer sheet given in Example 53.

The above-mentioned protective layer-transfer sheet may be illustrated as shown in FIGS. 7 and 8, wherein protective layer 3 was formed with spaces in the plane direction on support 1 and backing layer 5 was formed on the rear surface of support 1.

| Protective layer-forming coating-solution | |
|---|---|
| Polyvinyl chloride resin [TK300 manufactured by Shinetsu Chemical Co., Ltd.] | 7.0 parts |
| A vinyl chloride-vinyl acetate copolymer [VYHH manufactured by Union Carbide Co.] | 2.0 parts |
| Titanium oxide [Idemitsu-Titania IT-OD having an average particle size of 20 nm, manufactured by Idemitsu Kosan Co., Ltd.] | 0.5 parts |
| Polyester-denatured silicone resin [X-24-8300 manufactured by Shinetsu Chemical Ind. Co., Ltd.] | 0.5 parts |
| Methylethyl ketone | 80.0 parts |
| Cyclohexanone | 10.0 parts |

Transfer of the Protective Layer

First, the protective layer of the resulting protective layer-transfer sheet and the image-receiving layer of the same image-formed image-receiving sheet as used in Comparative Example 1 were brought into superposedly contact with each other, and a thermal head was brought into contact therewith from the baking layer side of the protective layer-transfer sheet in quite the same conditions as in Example 1, so that a protective layer could be formed on the image-formed image-receiving layer. The resulting image was evaluated in the same evaluation methods as in the image-receiving sheet attached with the protective sheet. The results thereof are shown in Table-4.

EXAMPLE 54

A protective layer-transfer sheet was prepared in the following manner. A peelable layer-forming coating-solution having the following composition was dispersedly prepared by a ultrasonic dispersing machine and the resulting coating-solution was coated in a wire-bar coating process on the corona-discharged surface of a 25 μm-thick polyethylene terephthalate film [S100 manufactured by Diafoil Co., Ltd.] for serving as the support and then dried so as to have a dried thickness of 1.0 μm, at the same time, a protective layer-forming coating-solution having the following composition was coated on the resulting peelable layer in a wire-bar coating process and then dried so as to have have a dried thickness of 3 μm and to have spaces in the plane direction so that a protective layer could be prepared. Further, one or two drops of a nitrocellulose solution containing 50 wt % silicone resin [Dia-Allomer SP-712 manufactured by Dai-Nichi Seika Co., Ltd.] were dropped through a pippet on the rear surface not treated by any corona-discharge and were spread over the whole surface by a wire-bar so as to have a dried thickness of 0.5 μm and a backing layer was formed by applying a back-surface coating treatment, so that a protective layer-transfer sheet could be obtained.

Figure 9:
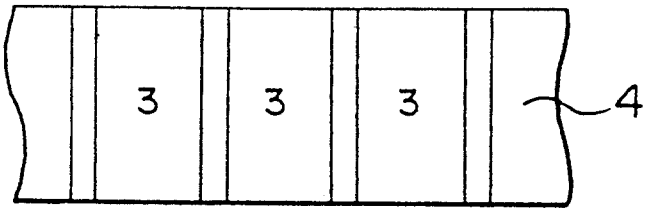
[FIG. 9] A top plan view of a protective layer-transfer sheet given in Example 54.
Figure 10:
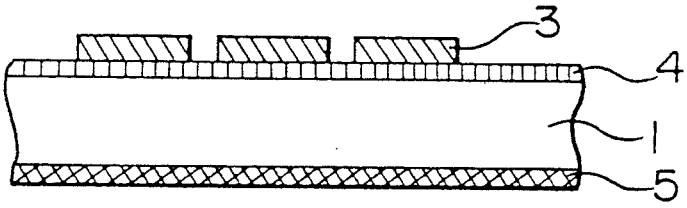
[FIG. 10] A cross-sectional view of a protective layer-transfer sheet given in Example 54.

The above-mentioned protective layer-transfer sheet may be illustrated as shown in FIGS. 9 and 10, wherein protective layer 3 was laminated with spaces in the plane direction on support 1 through peelable layer 4 and backing layer 5 was formed on the rear surface of support 1.

| Peelable layer-forming coating-solution | |
|---|---|
| Denatured silicone resin [Dai-Allomer SP-712 manufactured by Dai-Nichi Seika Co., Ltd.] | 5.0 parts |
| Calcium carbonate [having an average particle size of 0.5 μm] | 3.0 parts |
| Methylethyl ketone | 82.0 parts |
| Cyclohexanone | 10.0 parts |

-continued

| Protective layer-forming coating-solution | |
|---|---|
| Acryl type resin [Dianal BR83 manufactured by Mitsubishi Rayon Co., Ltd.] | 7.0 parts |
| Titanium oxide [Idemitsu-Titania IT-UD having an average particle size of 20 nm, manufactured by Idemitsu Kosan Co., Ltd.] | 2.0 parts |
| Light stabilizer [Irganox 168 manufactured by Ciba-Geigy AG.] | 1.0 part |
| Methylethyl ketone | 80.0 parts |
| Cyclohexanone | 10.0 parts |

An image-receiving sheet attached with a protective layer was prepared in the following manner. By making use of the same image-receiving sheet as the image-formed image-receiving sheet used in Comparative Example 1, the resulting protective sheet and the image-receiving layer surface of the image-formed image-receiving sheet were superposed together and the resulting superposed matter was subjected to a heat-pressure treatment at a pressure of 1.5 $Kg/cm^2$ and a temperature of 170° C. for 3 seconds, so that the image-receiving sheet attached with the protective sheet could be prepared. The resulting image was evaluated and the results thereof are shown in Table-4.

EXAMPLE 55

A peelable layer-forming coating-solution having the following composition was coated in a wire-bar coating process on the corona-discharged surface of a 25 μm-thick polyethylene terephthalate film [S100 manufactured by Diafoil Co., Ltd.] for serving as the support for the protective layer-transfer use and was then dried so as to have a dried thickness of 0.5 μm and, at the same time, a protective layer-forming coating-solution having the following composition was dispersedly prepared by a ultrasonic dispersing machine and coated in a wire-bar coating process on a peelable layer so as to have a dried thickness of 3 μm and the spaces in the plane direction and then dried, so that the protective layer could be formed. Further thereon, an adhesive layer-forming coating-solution having the following composition was coated and dried so as to have a dried thickness of 1 μm, so that the adhesive layer could be formed. Besides, one or two drops of a nitrocellulose solution containing 50 wt % silicone resin [Dai-Allomer SP-712 manufactured by Dai-Nichi Seika Co., Ltd.] were dropped through a pippet on the rear surface of the polyethylene terephthalate film which was not corona-discharged and the drops thereof were spread over the whole surface by making use of a wire-bar so as to have a dried thickness of 0.5 μm and a back-surface coating treatment was then so applied as to form a backing layer, so that the protective layer-transfer sheet could be obtained. The other treatments were carried out in the same manners as in Example 1.

Figure 11:
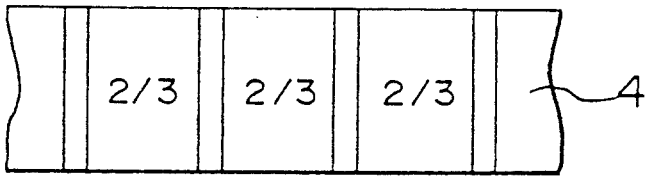
[FIG. 11] A top plan view of a protective layer-transfer sheet given in Example 55.
Figure 12:
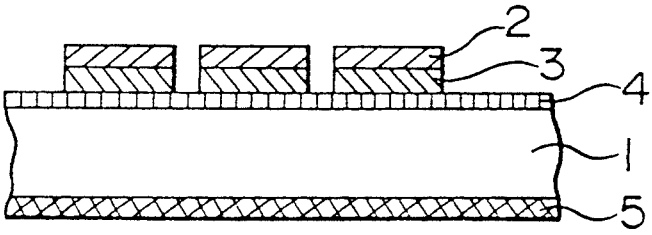
[FIG. 12] A cross-sectional view of a protective layer-transfer sheet given in Example 55.

The above-described protective layer-transfer sheet may be illustrated as shown in FIGS. 11 and 12, wherein peelable layer 4 was laminated on support 1 and protective layer 3 was formed on peelable layer 4 with spaces in the plane direction and adhesive layer 2 was further laminated on protective layer 3. In addition, backing layer 5 was formed on the rear side of support 1.

| Peelable layer-forming coating-solution | |
|---|---|
| Nitrocellulose [Celnova BTH ½ manufactured by Asahi Chemical Ind. Co., Ltd.] | 4.0 parts |

-continued

| | |
|---|---|
| Denatured silicone resin [Dai-Allomer SP-712 manufactured by Dai-Nichi Seika Co., Ltd.] | 4.0 parts |
| Methylethyl ketone | 82.0 parts |
| Cyclohexanone | 10.0 parts |
| Protective layer-forming coating-solution | |
| Polyvinyl acetal type resin [S-LEC KS-1 manufactured by Sekisui Chemical Ind. Co., Ltd.] | 4.9 parts |
| Titanium oxide [Idemitsu-Titania IT-UD having an average particle size of 20 nm, manufactured by Idemitsu Kosan Co., Ltd.] | 5.0 parts |
| Light stabilizer (Compound A) | 0.1 parts |
| Methylethyl ketone | 80.0 parts |
| Cyclohexanone | 10.0 parts |
| Adhesive layer-forming coating-solution | |
| Acryl type resin [Dianal BR-60 manufactured by Mitsubishi Rayon Co., Ltd.] | 10.0 parts |
| Methylethyl ketone | 80.0 parts |
| Cyclohexanone | 10.0 parts |

An image-receiving sheet attached with a protective layer was prepared in the following manner. By making use of the same image-formed image-receiving sheet as used in Comparative Example 1, the resulting protective sheet and the image-receiving layer surface of an image-formed image-receiving sheet were superposed together and the resulting superposed matter was subjected to a heat-pressure treatment at a pressure of 1.5 Kg/cm$^2$ and a temperature of 170° C. for 3 seconds, so that the image-receiving sheet attached with the protective sheet could be prepared. The resulting image was evaluated and the results thereof are shown in Table-4.

EXAMPLE 56

An image-receiving sheet attached with a protective layer was prepared in the same manner as in Example 53, except that the same image-formed image-receiving sheet as formed in Example 7 and the same image-formed image-receiving sheet which was transferred to protective layer as used in Example 53 were each used. The resulting image was evaluated and the results thereof are shown in Table-4.

EXAMPLE 57

An image-receiving sheet attached with a protective layer was prepared in the following manner. By making use of the same image-formed image-receiving sheet as formed in Example 13 and the same protective layer-transfer sheet as used in Example 54 were each used. The protective layer surface of the image-formed image-receiving sheet which was transferred to protective layer and the image-receiving layer surface of the image-formed image-receiving sheet were each superposed together. The resulting superposed matter was subjected to a heat-pressure treatment by making use of a heat-roll (at a temperature of 180° C., a pressure of 1.0 Kg/cm$^2$ and a transport speed of 0.5 cm/second). The resulting image was evaluated and the results thereof are shown in Table-4.

EXAMPLE 58

An image-receiving sheet attached with a protective layer was prepared in the same manner as in Example 54, except that the same image-formed image-receiving sheet as formed in Example 20 and the image-formed image-receiving sheet which was transferred to protective layer prepared by the coating solution used in Example 54 was replaced by the following protective layer-transfer sheet. The resulting image was evaluated and the results thereof are shown in Table-4.

| | |
|---|---|
| Peelable layer-forming coating-solution | |
| Nitrocellulose [Celnova BTH ½ manufactured by Asahi chemical Ind. Co., Ltd.] | 3.0 parts |
| Denatured silicone resin [Dai-Allomer SP-712 manufactured by Dai-Nichi Seika Co., Ltd.] | 5.0 parts |
| Methylethyl ketone | 82.0 parts |
| Cyclohexanone | 10.0 parts |
| Protective layer-forming coating-solution | |
| Acryl type resin [Dianal BR64 manufactured by Mitsubishi Rayon Co., Ltd.] | 7.0 parts |
| Titanium oxide [Idemitsu-Titania IT-UD having an average particle size of 20 nm, manufactured by Idemitsu Kosan Co., Ltd.] | 2.0 parts |
| Metal ion-containing compound [MS-1] | 1.0 part |
| Methylethyl ketone | 80.0 parts |
| Cyclohexanone | 10.0 parts |

EXAMPLE 59

An image-receiving sheet attached with a protective layer was prepared in the same manner as in Example 54, except that the same image-formed image-receiving sheet as formed in Example 24 and the image-formed image-receiving sheet which was transferred to protective layer formed with the same coating solution as used in Example 55 was replaced by those formed with the following coating solution. The resulting image was evaluated and the results thereof are shown in Table-4.

| | |
|---|---|
| Peelable layer-forming coating-solution | |
| Nitrocellulose [Celnova BTH ½ manufactured by Asahi Chemical Ind. Co., Ltd.] | 5.0 parts |
| Denatured silicone resin [Dai-Allomer SP-712 manufactured by Dai-Nichi Seika Co., Ltd.] | 3.0 parts |
| Methylethyl ketone | 82.0 parts |
| Cyclohexanone | 10.0 parts |
| Protective layer-transferring coating-solution | |
| Polyvinyl chloride resin [TK600 manufactured by Shinetsu Chemical Co., Ltd.] | 4.0 parts |
| Titanium oxide [Idemitsu-Titania IT-UD having an average particle size of 20 nm, manufactured by Idemitsu Kosan Co., Ltd.] | 5.0 parts |
| Light stabilizer [Irganox 168 manufactured by Ciba-Geigy AG.] | 1.0 part |
| Methylethyl ketone | 80.0 parts |
| Cyclohexanone | 10.0 parts |
| Adhesive layer-forming coating-solution | |
| A vinyl chloride-vinyl acetate copolymer [VYHH manufactured by Union Carbide Co.] | 9.0 parts |
| Metal ion-containing compound [MS-1] | 1.0 part |
| Methylethyl ketone | 80.0 parts |
| Cyclohexanone | 10.0 parts |

EXAMPLES 60~66

A image-formed image-receiving sheet which was transferred to protective layer was prepared in the same manner as in Examples 53~59, except that titanium oxide used in Examples 53~59 was replaced by zinc oxide having a particle size of 10 nm [Superfinely particulate zinc oxide ZnO-100 manufactured by Sumitomo Cement Co., Ltd.]. And, an image-receiving sheet attached with a protective layer was prepared in the same manner as above. The resulting image was evaluated and the results thereof are shown in Table-4.

EXAMPLE 67

An image-receiving sheet attached with a protective layer was prepared in the same manner as in Example 55, except that the protective layer of Example 55 was replaced by the protective layer having the following composition. The resulting image was evaluated and the results thereof are shown in Table-4.

| Protective layer-forming coating-solution | |
|---|---|
| Polyvinyl acetal type resin [S-LEC KS-1 manufactured by Sekisui Chemical Ind. Co., Ltd.] | 5.0 parts |
| Titanium oxide [Idemitsu-Titania IT-UD having an average particle size of 20 nm, manufactured by Idemitsu Kosan Co., Ltd.] | 1.0 part |
| Zinc oxide [Superfinely particulate zinc oxide ZnO-100 having an average particle size of 10 nm, manufactured by Sumitomo Cement Co., Ltd.] | 3.0 parts |
| Light stabilizer.antioxidant [Irganox B225 manufactured by Ciba-Geigy AG.] | 1.0 part |
| Methylethyl ketone | 80.0 parts |
| Cyclohexanone | 10.0 parts |

COMPARATIVE EXAMPLE 10

An image-receiving sheet attached with a protective layer was prepared in the same manner as in Example 53, except that the same image-formed image-receiving sheet as formed in Comparative Example 1 and a image-formed image-receiving sheet which was transferred to protective layer prepared by coating a protective layer-forming coating-solution having a composition which was the composition of the protective layer-forming coating-solution used in Example 53, from which titanium oxide was removed. The resulting image was evaluated and the results thereof are shown in Table-4.

COMPARATIVE EXAMPLE 11

An image-receiving sheet attached with a protective layer was prepared in the same manner as in Example 53, except that the same image-formed image-receiving sheet as formed in Comparative Example 1 and a image-formed image-receiving sheet which was transferred to protective layer prepared by coating a protective layer-forming coating-solution having the following composition in replace of the protective layer-forming coating-solution used in Example 53. The resulting image was evaluated and the results thereof are shown in Table-4.

| Protective layer-forming coating-solution | |
|---|---|
| Acryl type resin [Dianal BR83 manufactured by Mitsubishi Rayon Co., Ltd.] | 9.0 parts |
| UV absorbent [Tinuvin 320 manufactured by Ciba-Geigy AG.] | 1.0 part |
| Methylethyl ketone | 80.0 parts |
| Cyclohexanone | 10.0 parts |

COMPARATIVE EXAMPLE 12

An image-receiving sheet attached with a protective layer was prepared in the same manner as in Example 54, except that the same image-formed image-receiving sheet as formed in Comparative Example 4 and a protective layer-transfer sheet prepared by coating a protective layer-forming coating-solution having the following composition in replace of the protective layer-forming coating-solution used in Example 58. The resulting image was evaluated and the results thereof are shown in Table-4.

| Protective layer-forming coating-solution | |
|---|---|
| Acryl type resin [Dianal BR64 manufactured by Mitsubishi Rayon Co., Ltd.] | 8.5 parts |
| UV absorbent [Tinuvin 320 manufactured by Ciba-Geigy AG.] | 0.5 part |
| Metal ion-containing compound [MS-1] | 1.0 part |
| Methylethyl ketone | 80.0 parts |
| Cyclohexanone | 10.0 parts |

EXAMPLE 68

The following UV-hardened resin composition was dispersedly prepared by a ultrasonic dispersing machine and the resulting composition was coated, by a wire-bar, on the same image-receiving sheet attached with a protective layer as formed in Comparative Example 10 so as to have a hardened-thickness of 12 μm. The composition was exposed to UV rays emitted from a 60 W/cm$^2$ high-voltage mercury lamp from a distance of 10 cm for 4 seconds, so that the coated composition could be hardened. The temperature of the composition was kept at 20° C., immediately after exposing it to UV rays.

After providing the hardened-resin layer, the resulting image was evaluated in the same manner as in the image-receiving sheet attached with the protective sheet and the results thereof are shown in Table-5.

| UV-hardened resin composition | |
|---|---|
| Bisphenol A diglycidyl ether | 15.0 parts |
| 3,4-epoxycyclohexyl methyl-3,4-epoxycyclohexanone carboxylate | 64.0 parts |
| 1,4-butanediol glycidyl ether | 20.0 parts |
| Titanium oxide [Idemitsu-Titania IT-UD having an average particle size of 20 nm, manufactured by Idemitsu Kosan Co., Ltd.] | 1.0 part |
| Fluorine type surfactant | 1.0 part |
| Aromatic sulfonium salt type UV-initiator | 5.0 parts |

EXAMPLE 69

The following UV-hardened resin composition was dispersedly prepared by a ultrasonic dispersing machine and the resulting composition was coated, by a wire-bar, on the same image-receiving sheet attached with a protective layer as formed in Comparative Example 11 so as to have a hardened-thickness of 14 μm. After providing the hardened-resin layer in the same manner as in Example 68, the resulting image was evaluated and the results thereof are shown in Table-5.

| UV-hardened resin composition | |
|---|---|
| Side-chain type bisphenol A diglycidyl ether | 15.0 parts |
| 3,4-epoxycyclohexylmethyl-3,4-epoxycyclohexane carboxylate | 68.0 parts |
| Trimethylol propane triglycidyl ether | 15.0 parts |
| Titanium oxide [Idemitsu-Titania IT-UD having an average particle size of 20 nm, manufactured by Idemitsu Kosan Co., Ltd.] | 2.0 parts |
| Fluorine type surfactant | 2.0 part |
| Aromatic sulfonium salt type UV-initiator | 6.0 parts |

EXAMPLE 70

The following UV-hardened resin composition was dispersedly prepared by a ultrasonic dispersing machine and the resulting composition was coated, by a wire-bar, on the same image-receiving sheet attached with a protective layer as formed in Example 53 so as to have a hardened-thickness of 8 μm. After providing the hardened-resin layer in the same manner as in Example 68, the resulting image was evaluated and the results thereof are shown in Table-5.

| UV-hardened resin composition | |
|---|---|
| Side-chain type bisphenol A diglycidyl ether | 10.0 parts |
| 3,4-epoxycyclohexylmethyl-3,4-epoxycyclohexane carboxylate | 60.0 parts |
| Sorbitol polyglycidyl ether | 25.0 parts |
| Titanium oxide [Idemitsu-Titania IT-UD having an average particle size of 20 nm, manufactured by Idemitsu Kosan Co., Ltd.] | 5.0 parts |
| Fluorine type surfactant | 1.0 part |
| Aromatic sulfonium salt type UV-initiator | 6.0 parts |

EXAMPLE 71

The following UV-hardened resin composition was dispersedly prepared by a ultrasonic dispersing machine and the resulting composition was coated, by a wire-bar, on the same image-receiving sheet attached with a protective layer as formed in Example 57 so as to have a hardened-thickness of 5 μm. After providing the hardened-resin layer in the same manner a in Example 68, the resulting image was evaluated and the results thereof are shown in Table-5.

| UV-hardened resin composition | |
|---|---|
| Bisphenol F diglycidyl ether | 15.0 parts |
| Bis(3,4-epoxycyclohexylmethyl)adipate | 20.0 parts |
| 3,4-epoxycyclohexylmethyl-3,4-epoxycyclohexane carboxylate | 50.0 parts |
| Pentaerythritol polyglycidyl ether | 15.0 parts |
| Titanium oxide [Idemitsu-Titania IT-UD having an average particle size of 20 nm, manufactured by Idemitsu Kosan Co., Ltd.] | 10.0 parts |
| Fluorine type surfactant | 1.0 part |
| Aromatic sulfonium salt type UV-initiator | 5.0 parts |

EXAMPLE 72

The following UV-hardened resin composition was dispersedly prepared by a ultrasonic dispersing machine and the resulting composition was coated, by a wire-bar, on the same image-receiving sheet attached with a protective layer as formed in Example 59 so as to have a hardened-thickness of 14 μm. After providing the hardened-resin layer in the same manner as in Example 68, the resulting image was evaluated and the results thereof are shown in Table-5.

| UV-hardened resin composition | |
|---|---|
| Phenol novolak type polyglycidyl ether | 10.0 parts |
| 3,4-epoxycyclohexylmethyl-3,4-epoxycyclohexane carboxylate | 57.0 parts |
| Polyglycerol polyglycidyl ether | 25.0 parts |
| Higher aliphatic alcohol glycidyl ether | 5.0 parts |
| Titanium oxide [Idemitsu-Titania IT-UD having an average particle size of 20 nm, manufactured by Idemitsu Kosan Co., Ltd.] | 3.0 parts |
| Fluorine type surfactant | 1.0 part |
| Aromatic iodonium salt type UV-initiator | 4.0 parts |

EXAMPLE 73~77

In each of these examples, a hardened-resin layer was provided in the same manner as in Examples 68~72, except that titanium oxide contained in the UV-hardened resin composition used in Examples 68~72 was replaced by zinc oxide having a particle size of 15 nm [Superfinely particulate zinc oxide ZnO-200 manufactured by Sumitomo Cement Co., Ltd.]. The resulting image was evaluated and the results thereof are shown in Table-5.

EXAMPLE 78

The following UV-hardened resin composition was dispersedly prepared by a ultrasonic dispersing machine and the resulting composition was coated, by a wire-bar, on the same image-receiving sheet attached with a protective layer as formed in Example 59 so as to have a hardened-thickness of 3 μm. After the hardened-resin layer was provided in the same manner as in Example 68, the resulting image was evaluated and the results thereof are shown in Table-5.

| UV-hardened resin composition | |
|---|---|
| Hydrogenated bisphenol A diglycidyl ether | 25.0 parts |
| 3,4-epoxycyclohexyl methyl-3,4-epoxycyclohexane carboxylate | 35.0 parts |
| Bis(3,4-epoxycyclohexyl methyl) adipate | 13.0 parts |
| Trimethylol propane triglycidyl ether | 13.0 parts |
| Titanium oxide [Idemitsu-Titania IT-UD having an average particle size of 20 nm, manufactured by Idemitsu Kosan Co., Ltd.] | 4.0 parts |
| Zinc oxide [Superfinely particulate zinc oxide ZnO-200 having an average particle size of 15 nm, manufactured by Sumitomo Cement Co., Ltd.] | 10.0 parts |
| Silicone type surfactant | 3.0 parts |
| Aromatic sulfonium salt type UV-initiator | 5.0 parts |

COMPARATIVE EXAMPLE 13

A hardened-resin layer was provided in the same manner as in Example 68, except that titanium oxide was not added as the UV-hardened resin composition in Example 68. The resulting image was evaluated and the results thereof are shown in Table-5.

COMPARATIVE EXAMPLE 14

A hardened-resin layer was provided in the same manner as in Example 69, except that titanium oxide was not added as the UV-hardened resin composition in Example 69. The resulting image was evaluated and the results thereof are shown in Table-5.

EXAMPLE 79

Polyethylene terephthalate [Belpet EFG-7 manufactured by Kanegafuchi Chemical Ind. Co., Ltd.] containing 10 wt % titanium oxide having an average particle size of 0.3 μm and 5 wt % titanium oxide having an average particle size of 17 nm [Idemitsu-Titania IT-OD manufactured by Idemitsu Kosan Co., Ltd.]; the mixture thereof was fusedly kneaded well and the resulting kneaded matter was extruded from a film-forming die onto a water-cooled rotary rapid-cooling drum, so that an extruded matter could be obtained. The extruded matter was heated up to 80° C. and stretched to be 3.1:1 in the longitudinal direction and was then heated up to 85° C. and stretched to be in a stretching ratio of 3.4:1 in the lateral direction. After that, the resulting stretched matter was heat-set at a temperature of about 220° C. while dimensionally restricting it in a tenter, so that a 150 μm-thick polyethylene terephthalate film containing white titanium oxide could be obtained.

Next, the same image-receiving layer as that of Example 1 was provided and an image was formed by making use of the same ink sheet as used in Example 1. The resulting image was evaluated in the same manner as above and the results thereof are shown in Table-6.

EXAMPLE 80

A low-concentrated polyethylene (having a concentration of 0.918 and an MI of 7.0) containing 8 wt % titanium oxide having an average particle size of 0.3 μm and 4 wt % titanium oxide having an average particle size of 20 nm [Idemitsu-Titania IT-UD manufactured by Idemitsu Kosan Co., Ltd.]; such mixture was fusedly kneaded well. The resulting kneaded matter was fusedly laminated in an amount of 20 g/m$^2$ on the both sides of a 120 g/m$^2$ paper sheet for serving as the base material, and one of the surfaces thereof was then corona-discharged. On the corona-discharged surface, an aqueous gelatin solution containing a layer hardener was coated, set and then dried up, so that a 1 μm-thick sublayer could be formed.

Next, the same image-receiving layer as that of Example 9 was provided onto the resulting sublayer and an image was formed by making use of the same ink sheet as that of Example 1. The resulting image was evaluated and the results thereof are shown in Table-6.

EXAMPLE 81 a) Polypropylene having a concentration of 90.0·MI of 7.0 and containing 5 wt % titanium oxide (having an average particle size of 0.3 μm) and 7 wt % titanium oxide having an average particle size of 20 nm [Idemitsu-Titania IT-UD manufactured by Idemitsu Kosan Co., Ltd.]; the mixture thereof was fusedly kneaded well and the kneaded matter was then fusedly extruded in an amount of 40 g/m$^2$ on one surface of a 350 μm-thick white pigment-containing white polyethylene terephthalate film [Melinex 226 manufactured by ICI]; and b) polypropylene having a concentration of 0.90·MI of 7.0 and containing 12 wt % titanium oxide (having an average particle size of 0.3 μm); the mixture thereof was fusedly kneaded well and the kneaded matter was then fusedly extruded in an amount of 40 g/m$^2$ on the rear surface of the film, so that a polyolefin-coated base material could be obtained. After corona-discharging the surface of a), a sublayer-forming coating-solution having the following composition was dispersedly prepared by a ultrasonic dispersing machine and the resulting coating-solution was coated and dried in order, in a coating process, on the surface of a) and, after providing a 2 μm-thick sublayer, the resulting sublayer was hardened at 100° C. for one hour.

Next, the same image-receiving layer as that of Example 30 was provided onto the sublayer and an image was formed by making use of the same ink sheet as that of Example 20. The resulting image was evaluated and the results thereof are shown in Table-6.

| Sublayer-forming coating-solution | |
|---|---|
| Polyurethane resin [Takelac A-367H manufactured by Takeda Phermaceutical Ind. Co., Ltd.] | 5.5 parts |
| Hardener [Takenate A-7 manufactured by Takeda Phermaceutical Ind. Co., Ltd.] | 2.5 parts |
| Titanium oxide [Idemitsu-Titania IT-UD having an average particle size of 20 nm, manufactured by Idemitsu Kosan Co., Ltd.] | 2.0 parts |
| Methylethyl ketone | 80 parts |

-continued

| Sublayer-forming coating-solution | |
|---|---|
| Cyclohexanone | 10 parts |

EXAMPLES 82~84

A support or a support attached with a sublayer was prepared in the same manner as in Examples 78~80, except that titanium oxide having an average particle size of not larger than 20 nm used in Example 79~81 was replaced by zinc oxide having an average particle size of 10 nm [Superfinely particulate zinc oxide ZnO-100 manufactured by Sumitomo Cement Co., Ltd.]. The resulting image was evaluated and the results thereof are shown in Table-5.

EXAMPLE 85 a) polypropylene having a concentration of 90.0·MI of 7.0 and containing 5 wt % titanium oxide (having an average particle size of 0.3 μm) and 3 wt % titanium oxide having an average particle size of 20 nm [Idemitsu-Titania IT-UD manufactured by Idemitsu Kosan Co., Ltd.] and polypropylene having a concentration of 0.90 and an MI of 7.0 and containing 4 wt % zinc oxide having an average particle size of 10 nm [Superfinely particulate zinc oxide ZnO-100 manufactured by Sumitomo Cement Co., Ltd.]; the mixture thereof was fusedly kneaded well and the kneaded matter was then fusedly extruded in an amount of 40 g/m$^2$ on one surface of a 350 μm-thick white pigment-containing white polyethylene terephthalate film [Melinex 226 manufactured by ICI]; and b) polypropylene having a concentration of 0.90·MI of 7.0 and containing 12 wt % titanium oxide (having an average particle size of 0.3 μm); the mixture thereof was fusedly kneaded well and the kneaded matter was then fusedly extruded in an amount of 40 g/m$^2$ on the rear surface of the film, so that a polyolefin-coated base material could be obtained. After corona-discharging the surface of a), a sublayer-forming coating-solution having the following composition was dispersedly prepared by a ultrasonic dispersing machine and the resulting coating-solution was coated and dried in order, in a coating process, on the surface of a) and, after providing a 2 μm-thick sublayer, the resulting sublayer was hardened at 100° C. for one hour.

Next, the same image-receiving layer as that of Example 30 was provided onto the sublayer and an image was formed by making use of the same ink sheet as that of Example 20. The resulting image was evaluated and the results thereof are shown in Table-6.

| Sublayer-forming coating-solution | |
|---|---|
| Polyurethane resin [Takelac A-367H manufactured by Takeda Phermaceutical Ind. Co., Ltd.] | 4.0 parts |
| Hardener [Takenate A-7 manufactured by Takeda Phermaceutical Ind. Co., Ltd.] | 2.0 parts |
| Titanium oxide [Idemitsu-Titania IT-UD having an average particle size of 20 nm, manufactured by Idemitsu Kosan Co., Ltd.] | 1.0 part |
| Zinc oxide [Superfinely particulate zinc oxide ZnO-200 having an average particle size of 15 nm, manufactured by Sumitomo Cement Co., Ltd.] | 3.0 parts |
| Methylethyl ketone | 80 parts |
| Cyclohexanone | 10 parts |

COMPARATIVE EXAMPLE 15

A 150 μm-thick titanium oxide-containing polyethylene terephthalate film was prepared in the same manner as in Example 79, except that titanium oxide having the average particle size of 17 nm was replaced by titanium oxide having an average particle size of 0.3 μm.

Next, the same image-receiving layer as that of Comparative Example 1 was provided onto the resulting film and an image was then formed by making use of the same ink sheet as that of Example 1. The resulting image was evaluated and the results thereof are shown in Table-6.

COMPARATIVE EXAMPLE 16

In the same manner as in Example 80, except that titanium oxide having the average particle size of 20 nm was replaced by titanium oxide having an average particle size of 0.3 μm, a low-concentrated polyethylene (having a concentration of 0.918 and an MI of 7.0) containing titanium oxide was fusedly kneaded well and the resulting kneaded matter was fusedly laminated in an amount of 20 g/m$^2$ on the both surfaces of a paper sheet (having a weight of 120 g/m$^2$). One surface of the laminated matter was corona-discharged and thereon an aqueous gelatin solution containing a layer hardener was coated, set and then dried, so that a 3 μm-thick sublayer could be formed.

Next, the same image-receiving layer as that of Example 9 was provided onto the sublayer and an image was then formed by making use of the same ink sheet as that of Example 1. The resulting image was evaluated and the results thereof are shown in Table-6.

COMPARATIVE EXAMPLE 17

In the same manner as in Example 81, except that titanium oxide having the average particle size of 20 nm was replaced by titanium oxide having an average particle size of 0.3 μm, polypropylene was fusedly extruded in an amount of 40 g/m$^2$ on the both surfaces of a 350 μm-thick white pigment-containing white polyethylene terephthalate film [Melinex 226 manufactured by ICI], so that a polyolefin-coated base material could be obtained. After one surface of the base material was corona-discharged, a sublayer-forming coating-solution having the following composition was dispersedly prepared by a ultrasonic dispersing machine and the resulting coating-solution was coated, in a coating process, on the corona-discharged surface and then dried in order so that a 2 μm-thick sub layer could be proved. The resulting sublayer was then hardened at 100° C. for one hour.

Next, the same image-receiving layer as that of Example 30 was provided onto the sublayer and an image was then formed by making use of the same ink sheet as that of Example 20. The resulting image was evaluated and the results thereof are shown in Table-6.

| Sublayer-forming coating-solution | |
|---|---|
| Polyurethane resin [Takelac A-367H manufactured by Takeda Pharmaceutical Ind. Co., Ltd. | 5.5 parts |
| Hardener [Takenate A-7 manufactured by Takeda Pharmaceutical Ind. Co., Ltd.] | 2.5 parts |
| Titanium oxide [having an average particle size of 0.3 μm] | 2.0 parts |
| Methylethyl ketone | 80 parts |
| Cyclohexanone | 10 parts |

TABLE 1

| | Transfer density | Light fastness | Fixing property | Dye bleeding | Coloration in white background |
|---|---|---|---|---|---|
| Inventive Example | | | | | |
| 1 | ○ | ○ | ○ | ○ | ○ |
| 2 | ◎ | ○ | ○ | ○ | ○ |
| 3 | ○ | ○ | ○ | ○ | ○ |
| 4 | ◎ | ○ | ○ | ○ | ○ |
| 5 | ◎ | ◎ | ○ | ○ | ○ |
| 6 | ◎ | ◎ | ○ | ○ | ○ |
| 7 | ○ | ○ | ○ | ○ | ○ |
| 8 | ◎ | ◎ | ○ | ○ | ○ |
| 9 | ○ | ○ | ○ | ○ | ◎ |
| 10 | ◎ | ◎ | ○ | ○ | ○ |
| 11 | ◎ | ◎ | ○ | ○ | ○ |
| 12 | ◎ | ◎ | ○ | ○ | ○ |
| 13 | ○ | ○ | ○ | ○ | ○ |
| 14 | ◎ | ◎ | ○ | ○ | ○ |
| 15 | ○ | ◎ | ○ | ○ | ◎ |
| 16 | ◎ | ◎ | ○ | ○ | ○ |
| 17 | ◎ | ◎ | ○ | ○ | ◎ |
| 18 | ◎ | ◎ | ○ | ○ | ○ |
| 19 | ◎ | ◎ | ○ | ○ | ◎ |
| Comparative Example | | | | | |
| 1 | ◎ | X | Δ | Δ | ○ |
| 2 | ◎ | Δ | Δ | Δ | Δ |
| 3 | ◎ | Δ | Δ | Δ | Δ |

TABLE 2

| | Transfer density | Light fastness | Fixing property | Dye bleeding | Coloration in white background |
|---|---|---|---|---|---|
| Inventive Example | | | | | |
| 20 | ○ | ○ | ◎ | ○ | ○ |
| 21 | ◎ | ○ | ◎ | ○ | ○ |
| 22 | ○ | ○ | ◎ | ○ | ○ |
| 23 | ◎ | ◎ | ◎ | ○ | ○ |
| 24 | ○ | ○ | ◎ | ○ | ○ |
| 25 | ◎ | ◎ | ◎ | ○ | ○ |
| 26 | ○ | ○ | ◎ | ○ | ◎ |
| 27 | ◎ | ◎ | ◎ | ○ | ○ |
| 28 | ○ | ◎ | ◎ | ○ | ○ |
| 29 | ◎ | ◎ | ◎ | ○ | ○ |
| 30 | ○ | ○ | ◎ | ○ | ◎ |
| 31 | ◎ | ◎ | ◎ | ○ | ○ |
| 32 | ○ | ○ | ◎ | ○ | ◎ |
| 33 | ◎ | ◎ | ◎ | ○ | ◎ |
| Comparative Example | | | | | |
| 4 | ◎ | X | Δ | X | ○ |
| 5 | ◎ | X | Δ | X | X |
| 6 | ◎ | X | Δ | X | Δ |

TABLE 3

| | Transfer density | Light fastness | Dye bleeding | Coloration in white background |
|---|---|---|---|---|
| Inventive Example | | | | |
| 34 | ○ | ◎ | ○ | ◎ |
| 35 | ○ | ◎ | ○ | ◎ |
| 36 | ◎ | ◎ | ○ | ◎ |
| 37 | ◎ | ◎ | ○ | ◎ |
| 38 | ◎ | ◎ | ○ | ◎ |
| 39 | ○ | ◎ | ○ | ◎ |
| 40 | ○ | ◎ | ○ | ◎ |
| 41 | ◎ | ◎ | ○ | ◎ |
| 42 | ◎ | ◎ | ○ | ◎ |
| 43 | ○ | ◎ | ○ | ◎ |
| 44 | ◎ | ◎ | ○ | ◎ |
| 45 | ◎ | ◎ | ○ | ◎ |

TABLE 3-continued

| | Transfer density | Light fastness | Dye bleeding | Coloration in white background |
|---|---|---|---|---|
| 46 | ◎ | ◎ | ○ | ◎ |
| 47 | ◎ | ◎ | ○ | ◎ |
| 48 | ○ | ◎ | ○ | ◎ |
| 49 | ◎ | ◎ | ○ | ◎ |
| 50 | ◎ | ◎ | ○ | ◎ |
| 51 | ◎ | ◎ | ○ | ◎ |
| 52 | ◎ | ◎ | ○ | ◎ |
| Comparative Example | | | | |
| 7 | Δ | ◎ | Δ | ◎ |
| 8 | Δ | ◎ | Δ | Δ |
| 9 | ○ | ◎ | Δ | X |

TABLE 4

| | Transfer density | Light fastness | Dye bleeding | Coloration in white background |
|---|---|---|---|---|
| Inventive Example | | | | |
| 53 | ○ | ◎ | ○ | ○ |
| 54 | ◎ | ◎ | ○ | ◎ |
| 55 | ◎ | ◎ | ○ | ◎ |
| 56 | ○ | ◎ | ○ | ◎ |
| 57 | ◎ | ◎ | ○ | ◎ |
| 58 | ◎ | ◎ | ○ | ◎ |
| 59 | ◎ | ◎ | ○ | ◎ |
| 60 | ◎ | ◎ | ○ | ◎ |
| 61 | ◎ | ◎ | ○ | ◎ |
| 62 | ◎ | ◎ | ○ | ◎ |
| 63 | ◎ | ◎ | ○ | ◎ |
| 64 | ◎ | ◎ | ○ | ◎ |
| 65 | ◎ | ◎ | ○ | ◎ |
| 66 | ◎ | ◎ | ○ | ◎ |
| 67 | ◎ | ◎ | ○ | ◎ |
| Comparative Example | | | | |
| 10 | Δ | ○ | Δ | ○ |
| 11 | Δ | ○ | Δ | Δ |
| 12 | Δ | Δ | Δ | X |

TABLE 5

| | Transfer density | Light fastness | Dye bleeding | Coloration in white background |
|---|---|---|---|---|
| Inventive Example | | | | |
| 68 | ◎ | ◎ | ○ | ◎ |
| 69 | ◎ | ◎ | ○ | ◎ |
| 70 | ◎ | ◎ | ○ | ◎ |
| 71 | ◎ | ◎ | ○ | ○ |
| 72 | ○ | ◎ | ○ | ○ |
| 73 | ◎ | ◎ | ○ | ◎ |
| 74 | ◎ | ◎ | ○ | ◎ |
| 75 | ◎ | ◎ | ○ | ◎ |
| 76 | ◎ | ◎ | ○ | ◎ |
| 77 | ◎ | ◎ | ○ | ○ |
| 78 | ◎ | ◎ | ○ | ◎ |
| Comparative Example | | | | |
| 13 | Δ | ○ | Δ | Δ |
| 14 | Δ | ○ | Δ | Δ |

TABLE 6

| | Transfer density | Light fastness | Fixing property | Dye bleeding | Coloration in white background |
|---|---|---|---|---|---|
| Inventive Example | | | | | |
| 79 | ○ | ◎ | ○ | ○ | ○ |
| 80 | ○ | ◎ | ○ | ○ | ◎ |
| 81 | ○ | ◎ | ◎ | ○ | ◎ |
| 82 | ○ | ◎ | ○ | ○ | ○ |
| 83 | ○ | ◎ | ○ | ○ | ◎ |

TABLE 6-continued

| | Transfer density | Light fastness | Fixing property | Dye bleeding | Coloration in white background |
|---|---|---|---|---|---|
| 84 | ○ | ◎ | ◎ | ○ | ◎ |
| 85 | ◎ | ◎ | ◎ | ○ | ◎ |
| Comparative Example | | | | | |
| 15 | ○ | ○ | ○ | ○ | ○ |
| 16 | ○ | ○ | ○ | ○ | ○ |
| 17 | ○ | ○ | ◎ | ○ | ○ |

What is claimed is:

1. An image-protecting method for an image-recorded image-receiving sheet for thermal-transfer recording medium, which comprises a support and provided thereon, an image-recorded image-receiving layer and an adhesive layer;

said method comprising laminating a protective layer on the image-receiving layer surface of the image-recorded image-receiving sheet, and wherein there is contained in at least one layer selected from the group consisting of the support and the adhesive layer, fine powder having a particle size of not more than 200 nm which is selected from the group consisting of a titanium oxide and a zinc oxide said adhesive layer being located between the support and the image-receiving layer.

2. The image-protecting method for thermal transfer recording medium of claim 1, wherein at least one member selected from the group consisting of said image-receiving sheet, said support and said adhesive layer contains a light-stabilizer.

3. The image-protecting method of claim 1, wherein the fine powder is present in an amount of 0.1 to 50 wt. % of the components of the layer in which it is contained.

4. An image protecting method for an image-recorded image-receiving sheet for thermal transfer recording medium which comprises a support; and provided thereon an image-recorded image-receiving sheet, said method comprising forming a resin layer as a protective layer on the image-receiving layer surface of the image-recorded image-receiving sheet for thermal-transfer recording medium, and wherein said resin layer contains fine powder of zinc oxide or titanium oxide having a particle size of not more than 200 nm.

5. The image protecting method of claim 4, wherein at least one of said image-receiving layer or said protective layer contains a light-stabilizer.

6. The image-protecting method of claim 4, wherein said resin layer contains 0.1 to 50 wt. % of the fine powder, based on the components of the resin layer.

7. An image-recording material for thermal transfer recording medium which comprises:

a support;

and provided thereon, in sequence an image-recorded image-receiving sheet, a protective layer and a hardened resin layer, wherein at least one of said protective layer and said hardened resin layer contains a fine powder of zinc oxide or titanium oxide having a particle size of not more than 200 nm.

8. The image-recording material of claim 7, wherein the fine powder is present in an amount of 0.1 to 50 wt. % of the components of the layer in which it is contained.

9. An image-protecting method for an image-recorded image receiving sheet of a thermal transfer recording medium comprising the steps of:

forming a protective layer on the image-recorded image-receiving sheet; and forming a hardened resin layer thereon, wherein said protective layer or said hardened resin layer contains fine powder of titanium oxide or zinc oxide which powder has a particle size of not more than 200 nm.

10. The image-protecting layer of claim 9, wherein the fine powder is present in an amount of 0.1 to 50 wt. % of the components of the layer in which it is contained.

11. An image-recorded image-receiving sheet for thermal-transfer recording medium, which comprises a support and provided thereon, in sequence, an image-recorded image-receiving layer and a protective layer, wherein an inorganic oxide capable of absorbing UV-rays is contained in at least one layer selected from the group consisting of said support, said image-receiving layer and said protective layer.

12. The image-recorded image-receiving sheet for thermal-transfer recording medium of claim 11, further comprising an adhesive layer containing an inorganic oxide capable of absorbing UV-rays, interposed between said support and said image-receiving layer.

13. An image-recorded image-receiving sheet for thermal-transfer recording medium, which comprises a support and provided therein, in sequence, an image-recorded image-receiving layer, a protective layer and a hardened resin layer, wherein an inorganic oxide capable of absorbing UV-rays is contained in at least one layer selected from said protective layer or said hardened resin layer.

14. The image-recorded image-receiving sheet of claim 13, wherein the inorganic oxide is present in an amount of 0.1 to 50 wt. % of the components of the layer in which it is contained.

* * * * *